US006794818B1

(12) United States Patent
Myojo et al.

(10) Patent No.: US 6,794,818 B1
(45) Date of Patent: Sep. 21, 2004

(54) FLUORESCENT LAMP

(75) Inventors: Minoru Myojo, Osaka (JP); Kouichi Kitagawa, Osaka (JP); Takashi Ueda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/762,367

(22) PCT Filed: Jun. 7, 2000

(86) PCT No.: PCT/JP00/03711

§ 371 (c)(1),
(2), (4) Date: Apr. 2, 2001

(87) PCT Pub. No.: WO00/75959

PCT Pub. Date: Dec. 14, 2000

(30) Foreign Application Priority Data

| | | |
|---|---|---|
| Jun. 8, 1999 | (JP) | 11-160710 |
| Jan. 26, 2000 | (JP) | 2000-016767 |
| Mar. 9, 2000 | (JP) | 2000-064923 |

(51) Int. Cl.[7] ..... H01K 1/26; H01J 1/02; H01J 61/52; H01J 7/24

(52) U.S. Cl. ..... 313/580; 313/42; 313/43

(58) Field of Search ..... 313/11, 33, 42, 313/43, 46, 492, 631, 632, 491, 580, 271, 37, 489, 331; 315/56–60, 64–69, 71, 73–75, 100, 116, 119, 50

(56) References Cited

U.S. PATENT DOCUMENTS

| | | | | | |
|---|---|---|---|---|---|
| 3,969,279 A | * | 7/1976 | Kern | 252/518.1 |
| 4,205,258 A | * | 5/1980 | Ward | 315/73 |
| 4,495,440 A | * | 1/1985 | Schlitt et al. | 313/492 |
| 5,001,394 A | | 3/1991 | Bouchard | 313/619 |
| 5,034,661 A | * | 7/1991 | Sakurai et al. | 315/207 |
| 5,585,693 A | | 12/1996 | Shaffer | 313/489 |
| 5,610,477 A | * | 3/1997 | Ivanov et al. | 313/573 |
| 5,705,887 A | * | 1/1998 | Shaffer | 313/331 |
| 5,773,937 A | * | 6/1998 | Miyazaki et al. | 315/246 |
| 5,923,121 A | * | 7/1999 | Boyce et al. | 313/318.02 |

FOREIGN PATENT DOCUMENTS

| | | | |
|---|---|---|---|
| JP | 6-338289 | 12/1994 | H01J/61/30 |
| JP | 8-250066 | 9/1996 | H01J/61/24 |
| JP | 8-273593 | 10/1996 | |
| JP | 10-55780 | 2/1998 | H01J/61/36 |
| JP | 10-188906 | 7/1998 | H01J/61/56 |

* cited by examiner

*Primary Examiner*—Stephen Husar
*Assistant Examiner*—Peter Macchiarolo
(74) *Attorney, Agent, or Firm*—Merchant & Gould, P.C.

(57) ABSTRACT

A fluorescent lamp (10) includes a bulb (2) provided with a pair of electrode coils (3) at both ends thereof. Each of the electrode coils (3) is mounted between two lead wires (4*a*, 4*b*) held by a bulb-end glass (5). A means for preventing overheating (20) of the bulb-end glass is mounted between the lead wires (4*a*, 4*b*) located between the electrode coil (3) and the bulb-end glass (5). The means for preventing overheating (20) includes a glass member (20) and a first and a second metallic pin (22*a*, 22*b*) for supporting the glass member (20). One end of each of the metallic pins (22*a*, 22*b*) is connected to the lead wires (4*a*, 4*b*), respectively. Both metallic pins (22*a*, 22*b*) are provided not in contact with each other. Before the electrode coil (3) in the last period of the life, in which an emissive coating has been dissipated, is disconnected, the glass member (20) is heated by a conductive heat, a radiant heat, and intermittent pulse discharge. When the electrode coil (3) is disconnected, the glass member (20) is melted and ionically conducted. As a result, the bulb-end glass (5) is not melted, so that the fluorescent lamp can be maintained safely.

35 Claims, 28 Drawing Sheets

FLUORESCENT LAMP

TECHNICAL FIELD

The present invention relates to a fluorescent lamp that is operated with high frequencies in combination with an electronic ballast.

BACKGROUND ART

A large number of fluorescent lamps are turned on ordinarily with an electronic ballast, in which a capacitor is connected in parallel with a fluorescent lamp on the side opposed to a power source and in series with an electrode coil (hereinafter, this type of electronic ballast is referred to as a "C preheat type electronic ballast"). This is because a suitable electric current through a filament is required to preheat a fluorescent lamp cathode when it starts and to maintain the lighting, and a resonance voltage necessary for the lamp starting and operating should be ensured.

The reason this type of electronic ballast has spread most widely is that its circuit configuration is simple and inexpensive. In the C preheat type of electronic ballast, the current through a filament is relatively constant.

When a fluorescent lamp combined with the C preheat type of electronic ballast comes to the end of the life by the dissipation of the emissive coating on the electrode coil, the cathode fall voltage is raised. That results in the increase in the current through a filament, which causes the electrode coil to overheat by the excessive current. In addition to the heating from the electrode coil, an electrical discharge generates heat. Thus, the temperature in the vicinity of the electrode increases gradually. Under such circumstances, the lamp operation does not stop occasionally, even if the electrode coil is disconnected. In that case, the glass in the vicinity of the electrode between its terminals starts to be melted because of the constant-current property of the C preheat circuit, so that oscillation of the electronic ballast still continues after leakage of the fluorescent lamp.

In order to avoid these problems, the C preheat type of electronic ballast generally has the function of detecting a rise in the lamp voltage in accordance with a rise in the cathode fall voltage and cutting off an oscillation circuit beforehand or lowering an oscillation voltage to a safe level.

Furthermore, an electronic ballast in which another capacitor is added to the configuration of the above-described C preheat type of electronic ballast so as to be connected in parallel with a fluorescent lamp on the side nearer a power source (hereinafter, this type of electronic ballast is referred to as "double C type electronic ballast") has been put to practical use before. This electronic ballast is doubted to be commercialized again in the future. For the double C type of electronic ballast, a large amount of oscillation voltage is always applied across the fluorescent lamp, even if the electrode coil is disconnected.

However, when the fluorescent lamp, which is combined with such a C preheat type of electronic ballast including a double C type for lighting, comes to the end of the life, the failure of detection of a rise in the lamp voltage, though it rarely occurs, may cause a bulb-end glass in the vicinity of the electrode, e.g., a stem glass to be melted, even if the electronic ballast has the function of detecting a rise in the lamp voltage and cutting off the oscillation circuit beforehand or lowering the oscillation voltage to a safe level. Thus, it has been demanded to solve these problems.

DISCLOSURE OF INVENTION

Therefore, with the foregoing in mind, it is an object of the present invention to provide a fluorescent lamp in which a bulb-end glass is not melted after an electrode coil is disconnected in the last period of electrode life when the fluorescent lamp is turned on with a C preheat type electronic ballast, including a double C type.

A fluorescent lamp of the present invention includes a bulb provided with a pair of electrode coils at both ends thereof. Each of the electrode coils is mounted between two lead wires held by a bulb-end glass. A means for preventing overheating of the bulb-end glass is mounted between the lead wires located between the electrode coil and the bulb-end glass. The means for preventing overheating connects the lead wires electrically just before or after the electrode coil is disconnected.

This configuration can provide a fluorescent lamp that offers the excellent advantage of keeping the bulb-end glass safely at lower temperatures by electrically connecting the lead wires with the means for preventing overheating and of preventing the bulb-end glass from being melted, when an emissive coating is dissipated in the last period of electrode life of the fluorescent lamp, which ordinarily would increase the temperature of the electrode and its vicinities extraordinarily.

In a fluorescent lamp of the present invention, the means for preventing overheating has a first preferred configuration including a glass member and a first and a second metallic pin for supporting the glass member. One end of each of the first and the second metallic pin is connected to the lead wires, respectively. The first and the second metallic pin are provided not in contact with each other.

According to this preferred configuration, the glass member is heated by a conductive heat, a radiant heat, and intermittent pulse discharge after the emissive coating on the electrode coil in the last period of the life is dissipated and before the electrode is disconnected. In particular, the glass member in the base of the metallic pin is heated effectively by the intermittent pulse discharge. When the electrode coil is disconnected, ionic conduction occurs in the glass member, and thus the glass member starts melting. Furthermore, the two metallic pins may come into contact with each other by the flow of the molten glass member. This contact stops the glass member from melting (i.e., ionic conduction is interrupted). However, the electrical conduction (electronic conduction) between the metallic pins is continued.

Referring to another phenomenon, an increase in the current through a filament after emissive coating dissipation may cause the glass member to start melting because of the heat radiated from the electrode coil, even before the electrode coil is disconnected. In such a case, metal atoms sputtered from the electrode coil enter the molten portion of the glass member and bridge the two metallic pins, so that electronic conduction between the two metallic pins is established. Thus, a transition from the ionic conduction by the melting of the glass member to the electronic conduction occurs between a pair of metallic pins, and thereby the electrical conduction can be continued.

During the above period, the bulb-end glass is not melted, so that the fluorescent lamp can be protected against an excessive heat and maintained safely. Furthermore, even if the lamp in the above condition is restarted after it is turned off, the bulb-end glass is not melted. Thus, the fluorescent lamp can be maintained safely.

According to the first preferred configuration, since the glass member is held by a pair of metallic pins at both ends thereof and each of the metallic pins is connected to the two lead wires, respectively, the glass member can be mounted easily between the lead wires.

In the first configuration, the means for preventing overheating further may include a metallic container in which the glass member is housed. At least one of the first and the second metallic pin supports the glass member indirectly by supporting the metallic container. The glass member is housed in the metallic container so that a portion of the glass member is exposed to a discharge space.

According to this configuration, when the electrode coil in the last period of the life, in which an emissive coating has been dissipated, is disconnected, the glass member starts melting and conducting ionically. However, since the glass member is housed in the metallic container, the molten state can be maintained in the metallic container without producing a significant deformation of the glass member. During this period, the bulb-end glass is not melted, so that the fluorescent lamp can be maintained safely.

In the above configuration, it is preferable that the portion of the glass member exposed to the discharge space faces to the electrode coil. According to this preferred configuration, the portion of the glass member exposed to the discharge space can be locally heated effectively by the heat radiated from the electrode coil or the intermittent pulse discharge from the opposite electrode. This can ensure that the glass member is melted faster than the bulb-end glass.

Furthermore, it is preferable that one of the metallic pins is inserted into the glass member and the other is connected to the metallic container in which the glass member is housed. This preferred configuration allows the shape of the molten glass member to be maintained in the metallic container. In addition, a set of mounted members (means for preventing overheating) thus formed can be manufactured at a low price.

Furthermore, it is preferable that one of the metallic pins, which has been inserted into the glass member, has a fastener, and that the fastener comes into contact with the end surface of the glass member. Also, the length of the glass member housed in the metallic container in the insertion direction of the metallic pin is longer than the distance from the bottom face of the metallic container to the top in the insertion direction of the metallic pin. According to this preferred configuration, the glass member is fixed between the fastener of one of the metallic pins and the metallic container, and thus it does not fall off in any orientations of the lamp during operation. In addition, since the length of the glass member is longer than the depth of the metallic container, a portion of the glass member is projected from the metallic container and exposed directly to the source of radiant heat or a discharge space. As a result, the exposed portion of the glass member can be heated effectively by a conductive heat, a radiant heat, and intermittent pulse discharge after the emissive coating on the electrode coil in the last period of the life is dissipated and before the electrode is disconnected. After the disconnection of the electrode coil, the exposed portion of the glass member can be melted faster than the bulb-end glass. Furthermore, the molten glass member can be maintained at the position where it has been melted (in the metallic container) by the metallic pin having the fastener and the metallic container.

It is preferable that the end of the opening of the metallic container, in which the glass member is housed, is bent inward. According to this preferred configuration, the glass member does not fall off the metallic container before it is melted, regardless of the orientation of the lamp during operation. In addition, after the glass member is melted, the welding surface of the glass member adheres to the inner surface of the metallic container, which can prevent the glass member from falling off the metallic container.

It is preferable that the metallic container in which the glass member is housed is held by the metallic pins via an electrical insulator, and that a pair of metallic pins are provided in close proximity in the glass member. According to this preferred configuration, by adjusting the distance between a pair of metallic pins that are insulated electrically from the metallic container, the impedance between the lead wires in the glass member can be determined easily so as to ensure that the glass member in the metallic container is melted when the electrode coil is disconnected. In addition, this configuration can prevent the molten glass member from flowing out of the metallic container.

It is preferable that the surface of the glass member in the first configuration of the means for preventing overheating is coated with a non-conductive inorganic heat-resisting material.

According to this preferred configuration, the glass member is heated by a conductive heat, a radiant heat, and intermittent pulse discharge after the emissive coating on the electrode coil in the last period of the life is dissipated and before the electrode is disconnected. When the electrode coil is disconnected, the glass member starts melting and conducting ionically. However, since the outer surface of the glass member is coated with an inorganic heat-resisting material, the molten state can be maintained without producing a significant deformation of the glass member. During this period, the bulb-end glass is not melted, so that the fluorescent lamp can be maintained safely.

In the above configuration, it is preferable that both metallic pins are inserted into the glass member, and that the distance between the metallic pins is substantially equal to or shorter than the insertion length of the metallic pin into the glass member. This preferred configuration can prevent the molten glass member from falling off the metallic pins. In addition, the shape of the glass member can be maintained without being cut off by melting.

It is preferable that the point of the metallic pin in the glass member. differs from a portion that continues on to the point in cross section, or has a thickness larger than that of the portion that continues on to the point. This preferred configuration reliably can prevent the molten glass member from falling off the metallic pins.

It is preferable that the inorganic heat-resisting material has a melting point in excess of 200° C. or more above a softening point of the glass member. According to this preferred configuration, the inorganic heat-resisting material is not deformed, even at temperatures at which the glass member is melted. Thus, the glass member coated with the inorganic heat-resisting material is not cut off by melting, so that the shape of the glass member can be maintained substantially against the effect of gravity when a lamp is turned on.

It is preferable that a substance having a lower work function, more preferably cesium oxide, is attached to the surface of the metallic pin. This preferred configuration allows ion bombardment heating caused by main discharge between the electrodes to be concentrated on the metallic pins having a lower work function on the surface. Thus, the glass member rather than the bulb-end glass can be melted certainly.

Next, in a fluorescent lamp of the present invention, the means for preventing overheating has a second preferred configuration including a glass member mounted between the lead wires and a means for preventing falling of the glass member from the lead wires during melting.

According to this preferred configuration, the glass member is heated by a conductive heat, a radiant heat, and intermittent pulse discharge after the emissive coating on the electrode coil in the last period of the life is dissipated and before the electrode is disconnected. When the electrode coil is disconnected, the glass member starts melting and conducting ionically. However, the glass member does not fall off the lead wires because of the means for preventing falling, and thus the molten state can be maintained. During this period, the bulb-end glass is not melted, so that the fluorescent lamp can be maintained safely.

In the above configuration, the means for preventing falling can be provided on the circumference of the glass member. Furthermore, the means for preventing falling can be formed of a non-conductive inorganic heat-resisting material (e.g., ceramic coating) or a metallic band. This configuration can facilitate manufacturing of the means for preventing overheating provided with the means for preventing falling.

Next, in a fluorescent lamp of the present invention, it is preferable that the means for preventing overheating has a third preferred configuration including a glass member, and that an electrical volume resistance of the glass member is lower than that of the bulb-end glass. According to this preferred configuration, when the electrode coil is disconnected, the glass member rather than the bulb-end glass is melted and ionically conducted selectively. Thus, the bulb-end glass is not melted, so that the fluorescent lamp can be maintained safely.

Furthermore, in a fluorescent lamp of the present invention, it is preferable that the means for preventing overheating has a fourth preferred configuration including a glass member, and that the electrical conduction between the lead wires through the glass member is continued just before or after the electrode coil is disconnected. According to this preferred configuration, the glass member has been heated by a conductive heat, a radiant heat, and intermittent pulse discharge after the emissive coating on the electrode coil in the last period of the life is dissipated and before the electrode is disconnected. The glass member becomes conductive ionically and is melted selectively before or after the electrode coil is disconnected. Thus, the bulb-end glass is not melted, so that the fluorescent lamp can be maintained safely.

In a fluorescent lamp of the present invention, it is preferable that at least a portion of the surface of the bulb-end glass in the lamp is coated with a non-conductive inorganic heat-resisting material. According to this preferred configuration, the bulb-end glass supporting the lead wires is not heated locally by ion bombardment caused by main discharge between the electrodes. Thus, the glass member in the means for preventing overheating can be melted certainly faster than the bulb-end glass.

In a fluorescent lamp of the present invention, it is preferable that the means for preventing overheating is located closer to the electrode coil than to the bulb-end glass. This preferred configuration allows the means for preventing overheating to be subjected more to the heat radiated from the electrode coil that glows red-hot before disconnection. Thus, when the electrode coil is disconnected, the glass member in the means for preventing overheating can be melted faster than the bulb-end glass.

BEST MODE FOR CARRYING OUT THE INVENTION

Embodiment I-1

Figure 1:
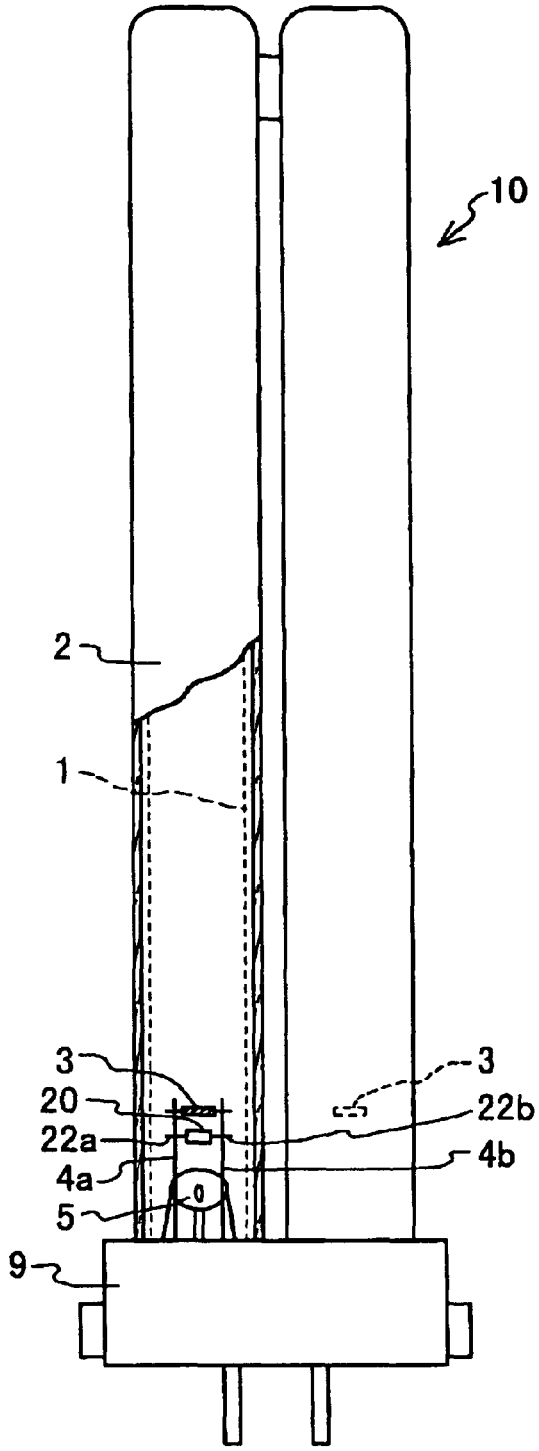
FIG. 1 is a partial cutaway front view showing a fluorescent lamp according to Embodiment I-1 of the present invention.

FIG. 1 shows a fluorescent lamp 10 of Embodiment I-1 of the present invention. The fluorescent lamp 10 is a 36-watt fluorescent lamp having a bridge junction, including a bulb 2 whose inner surface is coated with phosphors 1 and electrode coils 3 provided at both ends of the bulb 2. The electrode coils 3 have the same structure, so that the detailed description of the mounting portion of one electrode coil 3 is omitted. The bulb 2 is filled with argon gas at appropriate pressures (several 100 Pa) and mercury drops, and a resin base 9 that is made of polyethylene terephthalate and resists temperatures up to 155° C. is attached thereto in the final stage (of the fabrication).

Figure 2:
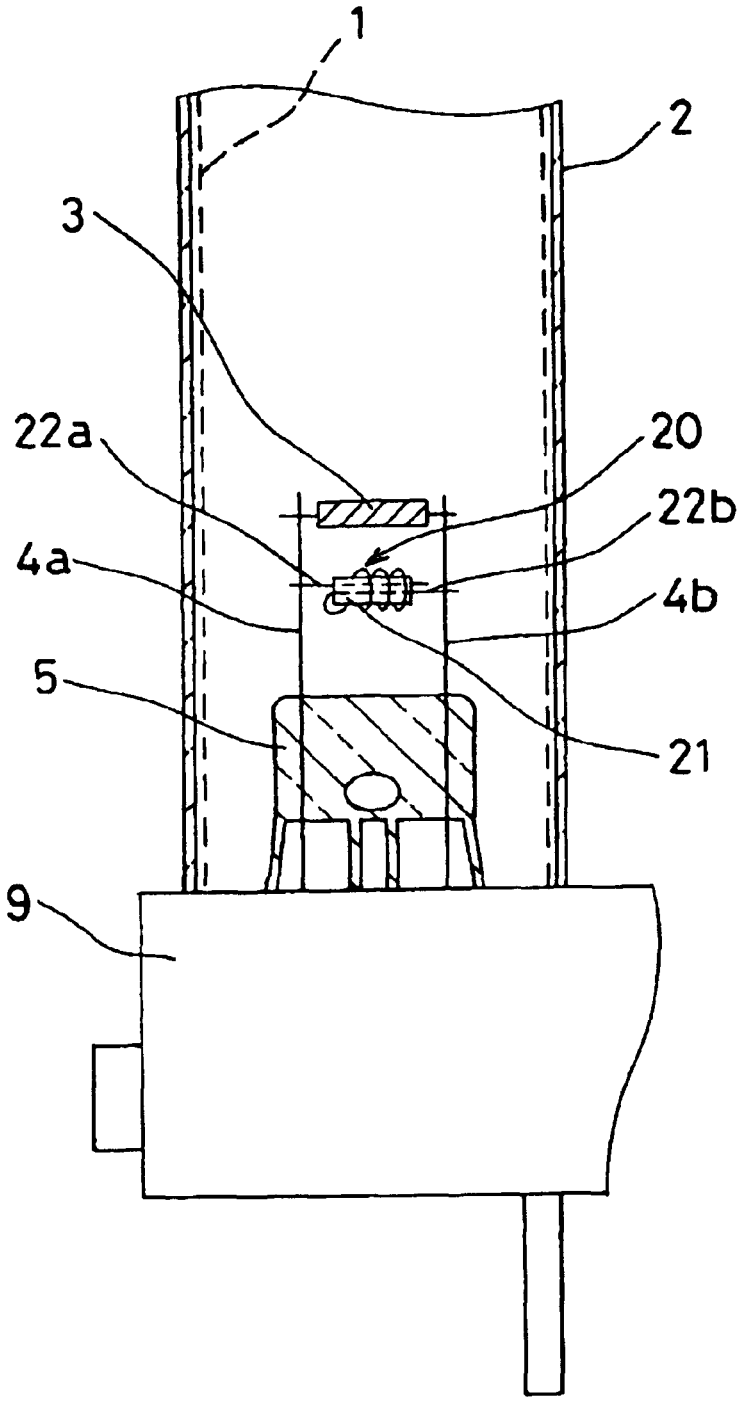
FIG. 2 is an enlarged cutaway front view showing a substantial part of the fluorescent lamp of FIG. 1.

As shown in FIG. 2, first and second lead wires 4*a*, 4*b* (made of nickel-plated iron wire) extend from a stem glass 5 attached to the end of the bulb 2 (made of soda-lime glass) to the inside of the lamp. The stem glass 5 is made of lead glass, and hereinafter referred to as "bulb-end glass 5". The electrode coil 3 is mounted between the lead wires 4*a* and 4*b*.

Furthermore, a means for preventing overheating 20 is mounted between the lead wires 4*a* and 4*b* so as to be placed between the bulb-end glass 5 and the electrode coil 3.

Figure 3:
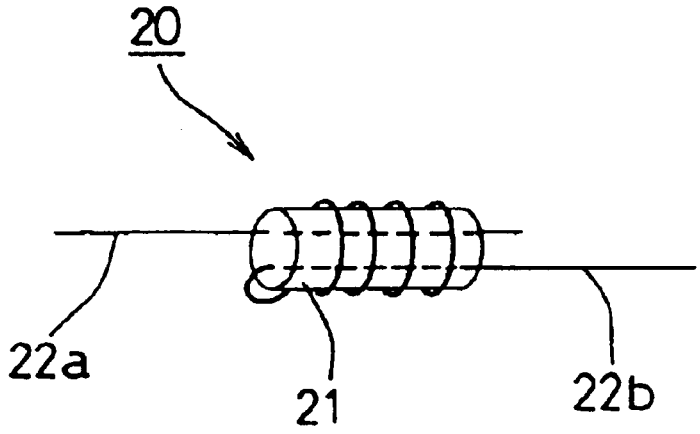
FIG. 3 is an enlarged perspective view showing a means for preventing overheating of the fluorescent lamp end of FIG. 1.

As shown in FIG. 3, the means for preventing overheating 20 includes a glass member 21, which is substantially cylindrical and has an outer diameter of 2 mm and a length of 3 mm, and two metallic pins 22*a*, 22*b*. The glass member 21 is made of soda-lime glass having a softening point of 695° C. The metallic pins 22*a*, 22*b* are made of nickel-plated iron wire and have a wire diameter of 0.5 mm. One end of each of the metallic pins 22*a*, 22*b* is connected to the lead wires 4*a*, 4*b*, respectively. The metallic pin 22*a* passes through the glass member 21, and the other end thereof remains projected from the glass member 21. The metallic pin 22*b* passes through the glass member 21, and the other end thereof is wound around the glass member 21. In this case, the metallic pins 22*a*, 22*b* are spaced apart via the glass member 21 and not in contact with each other. The portion of each of the metallic pins 22*a*, 22*b* in the glass member 21 is fused thereto. In FIG. 3, the portion of each of the metallic pins 22*a*, 22*b* in the glass member 21 is indicated by broken lines.

The means for preventing overheating 20 is mounted between the lead wires 4*a* and 4*b* in parallel with the electrode coil 3. The distance between the metallic pins 22*a* and 22*b* that are spaced apart in the glass member 21 is about 1 mm. The glass member 21 exposed to a discharge space is located a minimum of 3 mm away from the electrode coil 3.

Figure 26:
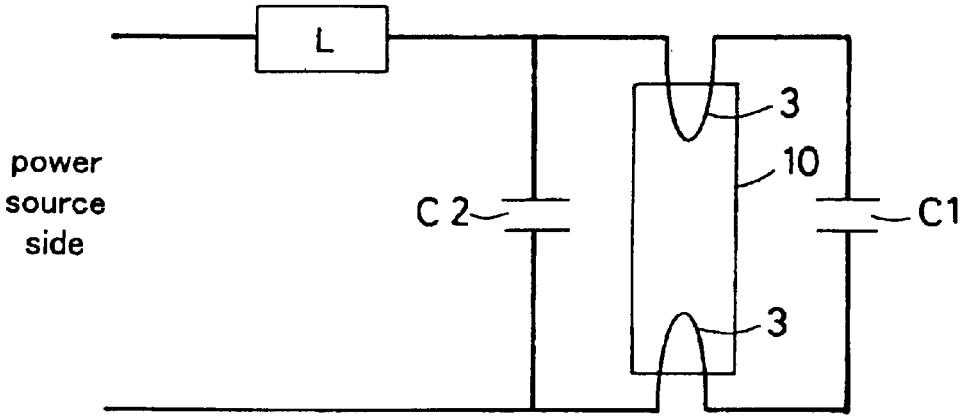
FIG. 26 is a block diagram showing a circuit of double C type electronic ballast used for a lighting test of a fluorescent lamp.

The fluorescent lamp of this embodiment is combined with a C preheat type of electronic ballast (double C type; a large resonant voltage is generated constantly across a fluorescent lamp, regardless of its condition) for lighting, as shown in FIG. 26. The electronic ballast, which does not have the function of detecting a rise in the voltage of a lamp, includes capacitors C1 and C2: The capacitor C1 is connected in series with the electrode coil 3 of the fluorescent lamp 10 and in parallel with the fluorescent lamp 10 on the side thereof opposed to the power source, and the capacitor C2 is connected in parallel with the fluorescent lamp 10 on the power source side thereof.

Figure 28:
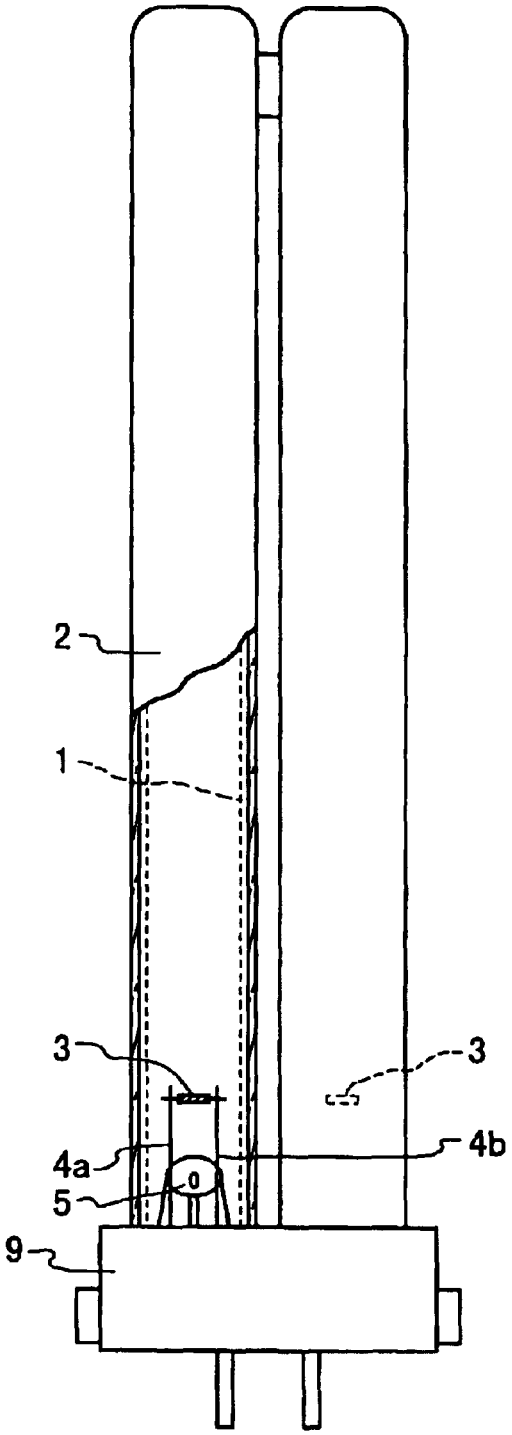
FIG. 28 is a partial cutaway front view showing a conventional fluorescent lamp.

For comparison, a fluorescent lamp without a means for preventing overheating (hereinafter, referred to as "comparative lamp" as shown in FIG. 28 is prepared. In FIG. 28, the identical elements to those in FIG. 1 are denoted by the same reference numerals, and the detailed description thereof will be omitted.

In the fluorescent lamp of this embodiment, when an emissive coating is dissipated in the last period of electrode life, the electrode coil 3 generates heat extraordinarily because a cathode fall voltage rises to increase the current flowing into the electrode coil 3. The portion of the glass member 21 exposed to the discharge space is heated locally by the heat conducted from the electrode coil 3 through the lead wires 4*a*, 4*b* and the heat radiated directly from the electrode coil 3, and further by ion bombardment heating caused by intermittent pulse discharge from the electrode coil 3 of the opposite side, so that ion activation is caused in this portion, i.e., the ionic current can be prepared to flow locally into the glass.

When the electrode coil 3 is disconnected, a driving source, in which internal impedance is relatively large and constant-current property is high, for the current that has flowed into the electrode coil 3 via the capacitor C1 requires another closed circuit. As a result, a large amount of ionic current begins to flow instantly into the locally heated portion of the glass member 21 between the metallic pins 22*a* and 22*b*. Thus, the metallic pins 22*a* and 22*b* are connected electrically, and the glass member 21 begins to melt. At this time, the bulb-end glass 5 does not begin to melt before the glass member 21. Thereafter, the molten portion of the glass member 21 increases gradually. However, since the other end of the metallic pin 22*b* is wound around the glass member 21, the molten piece of the glass member 21 does not fall off the metallic pins 22*a*, 22*b* and remains held by them. Therefore, the closed circuit is maintained so that the electrical conduction between the metallic pins 22*a* and 22*b* is continued.

Furthermore, even if the molten piece of the glass member 21 flows along the metallic pins 22*a*, 22*b*, the two metallic pins 22*a*, 22*b* can come into contact with each other in accordance with the flow of the molten piece, so that the closed circuit is maintained (electronic conduction). Thus, also in the case where the metallic pins are connected directly to each other, the electrical conduction between the metallic pins 22*a* and 22*b* can be continued.

When the glass member 21 is melted, the oscillation of the electronic ballast cannot be stopped. However, the resin base 9 can be kept at temperatures lower than the temperature it resists (155° C.). Furthermore, the bulb-end glass 5 is not melted, and thus the fluorescent lamp of this embodiment can be maintained safely.

In the case where the electronic ballast is restarted after it is stopped for a while (when the double C type electronic ballast is used, a lamp starts even if the electrode coil 3 is disconnected), the glass member 21 always can be melted selectively. The reason for this is as follows: The ion bombardment heating caused by intermittent pulse discharge tends to be more intensive at the base of the metallic pins 22*a*, 22*b* in the vicinity of the glass member 21, where a discharge distance becomes shorter, than at the base of the lead wires 4*a*, 4*b* in the vicinity of the bulb-end glass 5; in addition, the distance of the ionic conduction between the metallic pins 22*a* and 22*b* in the glass member 21 is shorter than that between the lead wires 4*a* and 4*b* in the bulb-end glass 5.

On the other hand, in the case where the electronic ballast is restarted after the metallic pins 22*a*, 22*b* come into direct contact with each other and the electronic conduction is achieved, the peripheral glass including the glass member 21 is not melted (i.e., ionic conduction does not occur).

During the period of time when the glass member 21 is in the molten state and the electronic ballast is charged with electricity, the bulb-end glass 5 is not melted.

Furthermore, when the fluorescent lamp is turned on normally before the emissive coating on the electrode coil 3 is dissipated, the impedance of the glass member 21 between the metallic pins 22*a* and 22*b* at the temperature at that state is three or more orders of magnitude larger than the resistance of the electrode coil 3. Thus, the current from the driving source that supplies current to the electrode coil 3 via the capacitor Cl flows substantially through the electrode coil 3 alone.

Referring to an example of the process that is different from the above embodiment, an increase in the current through a filament after the emissive coating dissipation in the electrode coil 3 may cause the glass member 21 to start melting because of the radiant heat from the electrode coil 3, even before the electrode coil 3 is disconnected. In this case, metal atoms (tungsten) sputtered from the electrode coil 3 enter the molten glass member 21 and bridge the two metallic pins 22*a*, 22*b*, so that the metallic pins 22*a*, 22*b* are connected electrically in the glass member 21 (electronic conduction). Thereafter, the same operations as described above are carried out.

On the other hand, in the case where the comparative lamp is combined with the above electronic ballast for lighting, after an emissive coating is dissipated and before the electrode coil 3 is disconnected, the bulb-end glass 5 is locally heated mainly by ion bombardment caused by the intermittent pulse discharge between the electrodes. Following the disconnection of the electrode coil 3, the bulb-end glass 5 is melted certainly, so that a lamp container (bulb 2) is broken. In addition, the temperature of the resin base 9 is raised, which results in deformation thereof.

Figure 27:
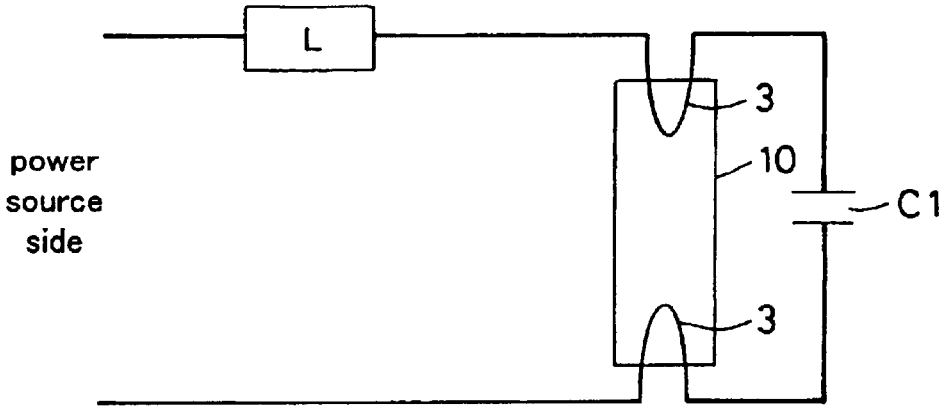
FIG. 27 is a block diagram showing a circuit of C preheat type electronic ballast used for a lighting test of a fluorescent lamp.

A lighting test is conducted in such a manner that the fluorescent lamp of this embodiment is combined with a C preheat type electronic ballast (see FIG. 27), which is not a double C type. In the test, the glass member 21 has been heated until the electrode coil 3 is disconnected after an emissive coating is dissipated, by the heat radiated from the red-hot electrode coil 3, the heat conducted through the lead wires 4*a*, 4*b*, and ion bombardment heating caused by the intermittent pulse discharge between the electrodes. As soon as the electrode coil 3 is disconnected, the glass member 21 is melted. In this case, since the other end of the metallic pin 22*b* is wound around the glass member 21, the molten state can be maintained.

When the electronic ballast is restarted after the fluorescent lamp is turned off, it does not oscillate because the electrode coil 3 has been disconnected. Thus, the present lamp does not start. However, in the case where the molten piece of the glass member 21 flows along the metallic pins 22*a*, 22*b* so that the metallic pins 22*a*, 22*b* are connected directly to each other, the lamp is activated by this electronic ballast. In such a case, like the above, the electrical conduction between the metallic pins 22*a* and 22*b* is continued, the resin base 9 can be kept at temperatures lower than the temperature it resists, and the bulb-end glass 5 is not melted. Thus, the fluorescent lamp of this embodiment can be maintained safely.

In the above embodiment, the metallic pin 22*a* may remain in the glass member 21 instead of penetrating through it.

Embodiment I-2

Figure 4:
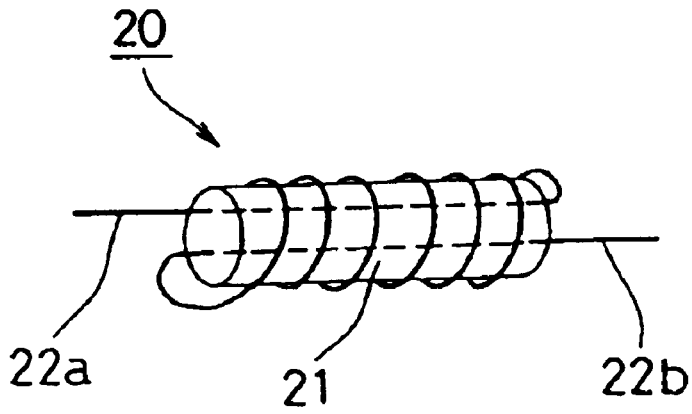
FIG. 4 is an enlarged perspective view showing a means for preventing overheating of a fluorescent lamp end according to Embodiment I-2 of the present invention.

In Embodiment I-2 of the present invention, a means for preventing overheating 20 of the fluorescent lamp of Embodiment I-1 has the following configuration, as shown in FIG. 4. The metallic pins 22*a*, 22*b* pass through the glass member 21, and the other end of each of the metallic pins is wound around the glass member 21. This embodiment can provide the same effect as that described above. Furthermore, the metallic pins 22*a*, 22*b* are wound not in contact with each other. In FIG. 4, the portion of each of the metallic pins 22*a*, 22*b* in the glass member 21 is indicated by broken lines.

Embodiment I-3

Figure 5:
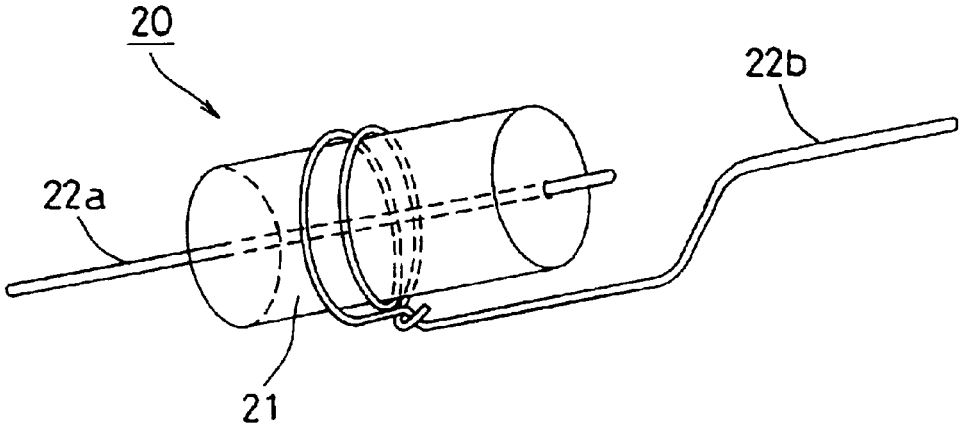
FIG. 5 is an enlarged perspective view showing a means for preventing overheating of a fluorescent lamp end according to Embodiment I-3 of the present invention.

In Embodiment I-3 of the present invention, a means for preventing overheating 20 of the fluorescent lamp of Embodiment I-1 has the following configuration, as shown in FIG. 5. The metallic pin 22*a* is inserted through the glass member 21. The metallic pin 22*b* does not pass through the glass member 21, and the other end thereof is wound directly around the glass member 21. This embodiment can provide the same effect as that described above. In this case, the end of the metallic pin 22*a* may be projected from the end surface of the glass member 21 as shown in FIG. 5, i.e., the metallic pin 22*a* passes through the glass member 21. Alternatively, it may be positioned in the glass member 21 instead of being projected. In FIG. 5, the portion of the metallic pin 22*a* in the glass member 21 and that of the metallic pin 22*b* behind the glass member 21 are indicated by broken lines.

Embodiment I-4

Figure 6:
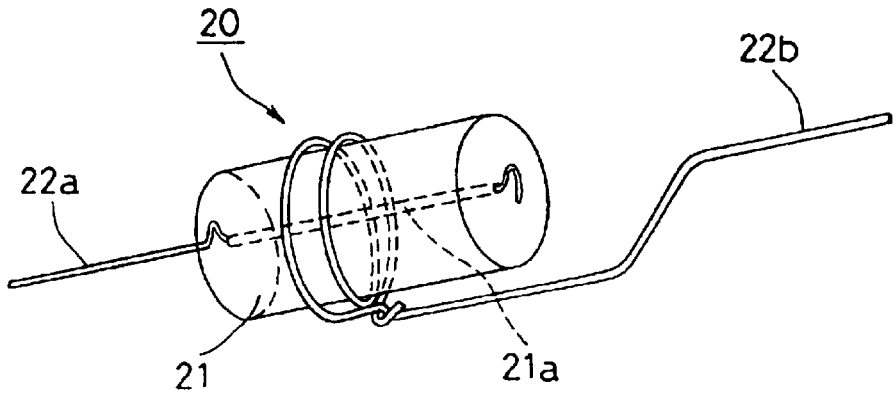
FIG. 6 is an enlarged perspective view showing a means for preventing overheating of a fluorescent lamp end according to Embodiment I-4 of the present invention.

In Embodiment I-4 of the present invention, a means for preventing overheating 20 of the fluorescent lamp of Embodiment I-1 has the following configuration, as shown in FIG. 6. The metallic pin 22*a* is inserted into an insertion hole 21*a*, which has been provided previously in the glass member 21. In other words, the metallic pin 22*a* and the glass member 21 are not fused together. This embodiment can provide the same effect as that described above. Furthermore, in this case, it is preferable that the portions of the metallic pin 22*a* in the vicinity of both ends of the glass member 21 are bent to prevent the glass member 21 from slipping off the metallic pin 22*a* when the glass member 21 is not melted. In FIG. 6, the insertion hole 21*a* provided in the glass member 21 and the portion of the metallic pin 22*b* behind the glass member 21 are indicated by broken lines.

Embodiment I-5

Figure 7:
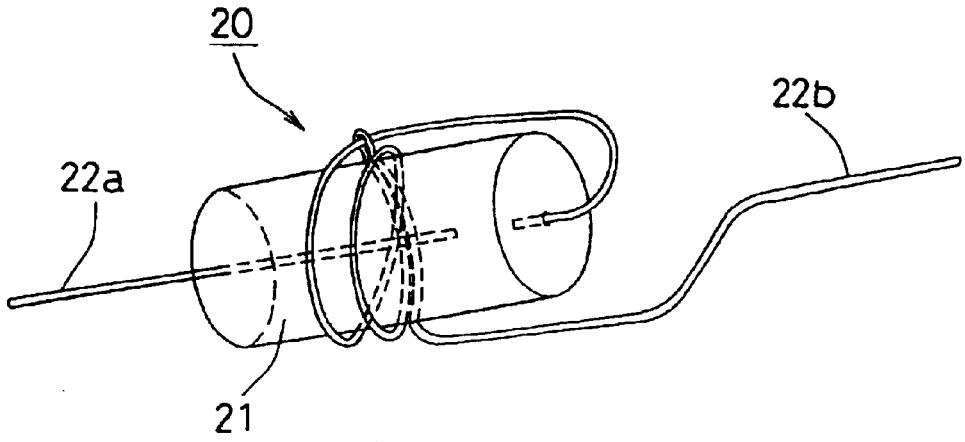
FIG. 7 is an enlarged perspective view showing a means for preventing overheating of a fluorescent lamp end according to Embodiment I-5 of the present invention.

In Embodiment I-5 of the present invention, a means for preventing overheating 20 of the fluorescent lamp of Embodiment I-1 has the following configuration, as shown in FIG. 7. The other end of the metallic pin 22*a* is positioned in the glass member 21. The mid-portion of the metallic pin 22*b* is wound around the grass member 21, and the other end thereof is positioned in the glass member 21. This embodiment can provide the same effect as that described above. In this case, the metallic pins 22*a*, 22*b* in the glass member 21 are not in contact with each other. Furthermore, the end of the metallic pin 22*a* may be projected from the end surface of the glass member 21, i.e., the metallic pin 22*a* passes through the glass member 21, so as not to come into contact with the metallic pin 22*b* instead of being positioned in the glass member 21, as shown in FIG. 7. In FIG. 7, the portion of each of the metallic pins 22*a*, 22*b* in the glass member 21 and the portion of the metallic pin 22*b* behind the glass member 21 are indicated by broken lines.

Embodiment I-6

Figure 8:
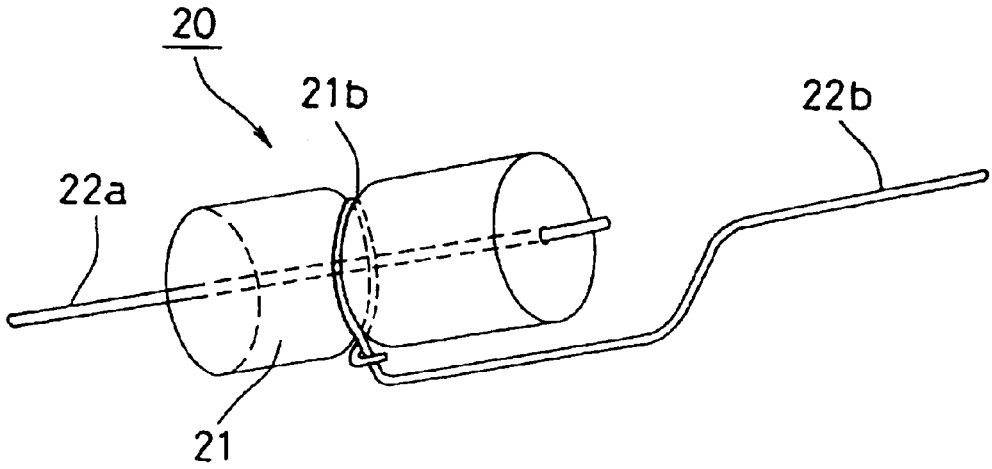
FIG. 8 is an enlarged perspective view showing a means for preventing overheating of a fluorescent lamp end according to Embodiment I-6 of the present invention.

In Embodiment I-6 of the present invention, a means for preventing overheating 20 of the fluorescent lamp of Embodiment I-1 has the following configuration, as shown in FIG. 8. The metallic pin 22*a* passes through the glass member 21 having a depression 21*b* formed substantially on a central portion thereof. The other end of the metallic pin 22*b* is wound around the depression 21*b* of the glass member 21. This embodiment can provide the same effect as that described above. Furthermore, the end of the metallic pin 22*a* may be positioned in the glass member 21 instead of being projected from the end surface of the glass member 21 as shown in FIG. 8. In FIG. 8, the portion of the metallic pin 22*a* in the glass member 21 and the portion of the metallic pin 22*b* behind the glass member 21 are indicated by broken lines.

Embodiment I-7

Figure 9:
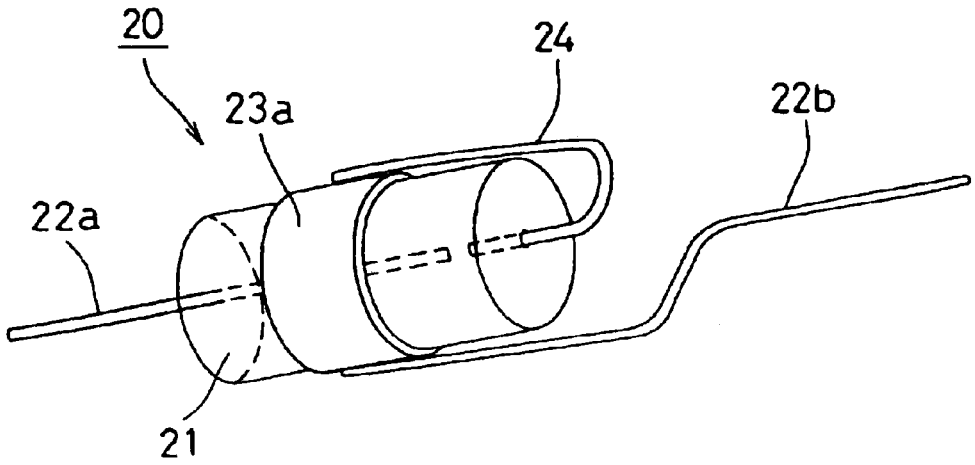
FIG. 9 is an enlarged perspective view showing a means for preventing overheating of a fluorescent lamp end according to Embodiment I-7 of the present invention.

In Embodiment I-7 of the present invention, a means for preventing overheating 20 of the fluorescent lamp of Embodiment I-1 has the following configuration, as shown in FIG. 9. The other end of the metallic pin 22*a* is positioned in the glass member 21. A metallic band 23*a* in the form of a plate, to which the other end of the metallic pin 22*b* is connected, is provided on the circumference of the glass member 21. This embodiment can provide the same effect as that described above. In this configuration, another metallic pin 24 may be provided so that one end thereof is connected to the metallic band 23*a* and the other end thereof is positioned in the glass member 21. In such a case, the same effect as that described above can be also obtained. Furthermore, in this embodiment, the end of the metallic pin 22*a* may be projected from the end surface of the glass member 21, i.e., the metallic pin 22*a* passes through the glass member 21, instead of being positioned in the glass member 21 as shown in FIG. 9. Also, a metallic band in the form of a net can be used as the metallic band 23*a*. In FIG. 9, the portion of each of the metallic pins 22*a*, 24 in the glass member 21 is indicated by broken lines.

Embodiment I-8

Figure 10:
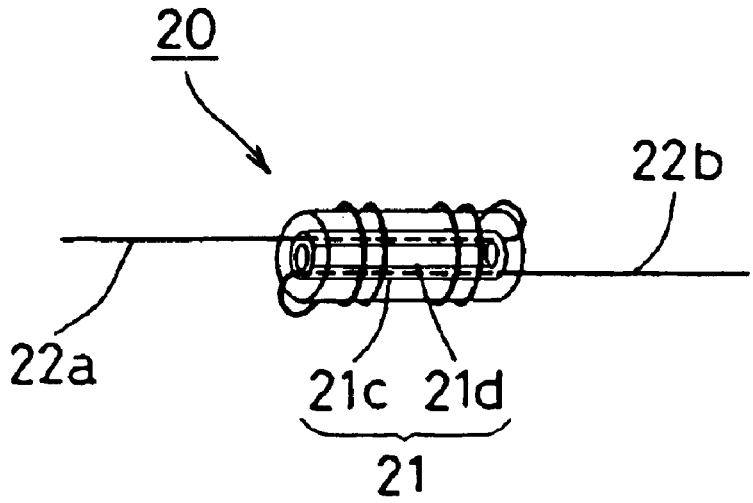
FIG. 10 is an enlarged perspective view showing a means for preventing overheating of a fluorescent lamp end according to Embodiment I-8 of the present invention.

In Embodiment I-8 of the present invention, a means for preventing overheating 20 of the fluorescent lamp of Embodiment I-1 has the following configuration, as shown in FIG. 10. The glass member 21 includes a hollow glass tube 21*c* and a glass rod 21*d* to be inserted into the glass tube 21*c*. The metallic pins 22*a*, 22*b* are inserted into the gap formed between the glass tube 21*c* and the glass rod 21*d*. The other ends of each of the metallic pins 22*a*, 22*b* that have passed through the glass member 21 are wound around the glass member 21 not in contact with each other. This embodiment can provide the same effect as that described above. In FIG. 10, the portion of each of the metallic pins 22*a*, 22*b* in the glass member 21 is indicated by broken lines.

Embodiment I-9

Figure 11:
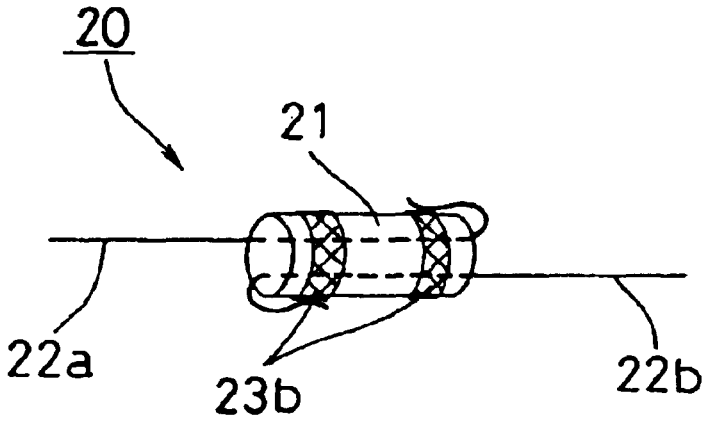
FIG. 11 is an enlarged perspective view showing a means for preventing overheating of a fluorescent lamp end according to Embodiment I-9 of the present invention.

In Embodiment I-9 of the present invention, a means for preventing overheating 20 of the fluorescent lamp of Embodiment I-1 has the following configuration, as shown in FIG. 11. Two metallic bands 23*b* in the form of a net are provided near both ends of the glass member 21 so as to be wound around them, respectively. The other ends of each of the metallic pins 22*a*, 22*b* are welded electrically to the respective metallic bands 23*b*. This embodiment can provide the same effect as that described above. Furthermore, a metallic band in the form of a plate without a mesh may be used as the metallic band. The use of these metallic bands increases the area where the molten glass member 21 comes into contact with the metallic bands, so that the molten piece can be maintained readily by the metallic bands. As a result, the reliability of continuous electrical conduction between the metallic pins 22*a* and 22*b* can be increased. In FIG. 11, the portion of each of the metallic pins 22*a*, 22*b* in the glass member 21 is indicated by broken lines.

Embodiment I-10

Figure 12:
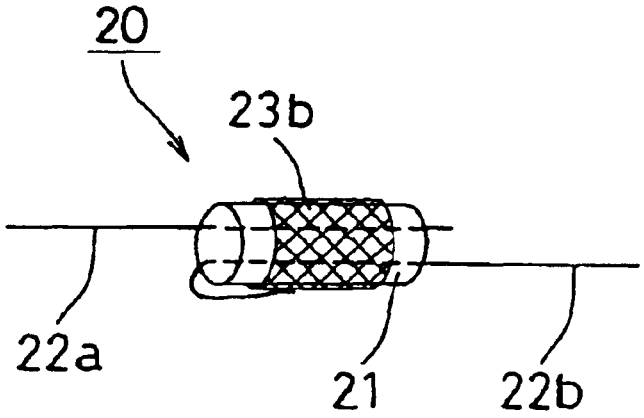
FIG. 12 is an enlarged perspective view showing a means for preventing overheating of a fluorescent lamp end according to Embodiment I-10 of the present invention.

In Embodiment I-10 of the present invention, a means for preventing overheating 20 of the fluorescent lamp of Embodiment I-1 has the following configuration, as shown in FIG. 12. A metallic band 23*b* is wound around the glass member 21. The other end of the metallic pin 22*b* that has passed through the glass member 21 is welded electrically to the metallic band 23*b*. The metallic pin 22*a* passes through the glass member 21. This embodiment can provide the same effect as that described above. In addition to a metallic band in the form of a net, a metallic band in the form of a plate without a mesh may be used as the metallic band 23*b*. Furthermore, the metallic pin 22*a* may remain in the glass member 21 instead of penetrating through it. In FIG. 12, the portion of each of the metallic pins 22*a*, 22*b* in the glass member 21 is indicated by broken lines.

Embodiment I-11

Figure 13:
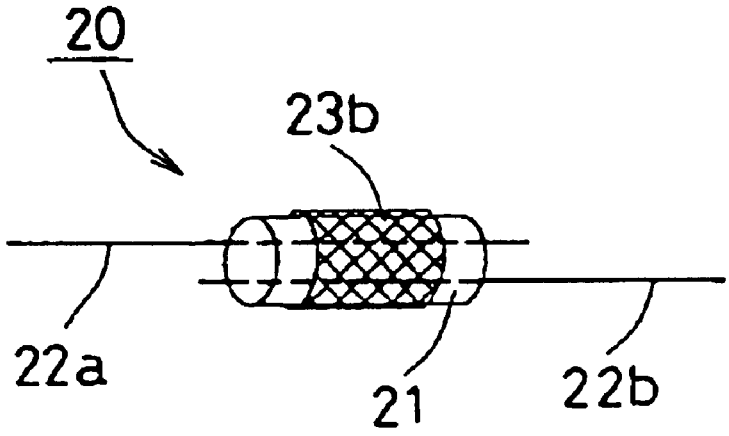
FIG. 13 is an enlarged perspective view showing a means for preventing overheating of a fluorescent lamp end according to Embodiment I-11 of the present invention.

In Embodiment I-11 of the present invention, a means for preventing overheating 20 of the fluorescent lamp of Embodiment I-1 has the following configuration, as shown in FIG. 13. A metallic band 23*b* is wound around the glass member 21. Unlike the above Embodiments I-9 and I-10, the other ends of each of the metallic pins 22*a*, 22*b* are not connected to the metallic band 23*b*. This embodiment can provide the same effect as that described above. In addition to a metallic band in the form of a net, a metallic band in the form of a plate without a mesh may be used as the metallic band 23*b*. Furthermore, the metallic pins 22*a*, 22*b* may remain in the glass member 21 instead of penetrating through it. In FIG. 13, the portion of each of the metallic pins 22*a*, 22*b* in the glass member 21 is indicated by broken lines.

Embodiment I-12

Figure 14:
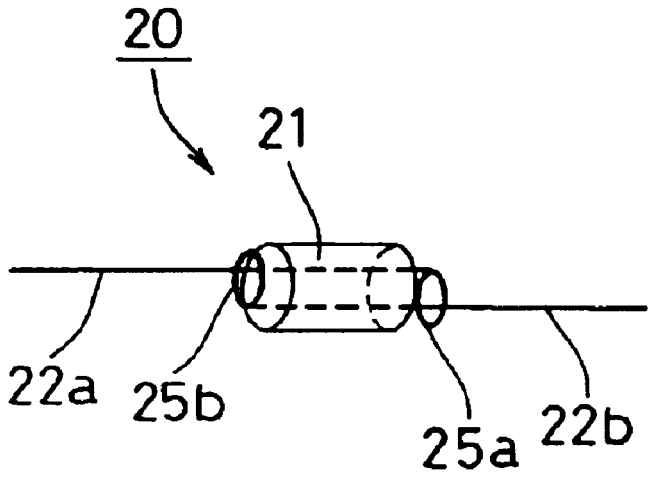
FIG. 14 is an enlarged perspective view showing a means for preventing overheating of a fluorescent lamp end according to Embodiment I-12 of the present invention.

In Embodiment I-12 of the present invention, a means for preventing overheating 20 of the fluorescent lamp of Embodiment I-1 has the following configuration, as shown in FIG. 14. Substantially annular portions 25*a*, 25*b* to be shaped into a ring are formed at the other ends of each of the metallic pins 22*a*, 22*b*, respectively. The metallic pins 22*a*, 22*b* are inserted alternately into the substantially annular portions 25*a*, 25*b*. In other words, the metallic pin 22*b* on the side of one end thereof is inserted through the substantially annular portion 25*a* at the other end of the metallic pin 22*a*. Similarly, the metallic pin 22*a* on the side of one end thereof is inserted through the substantially annular portion 25*b* at the other end of the metallic pin 22*b*. The metallic pins 22*a*, 22*b* pass through the glass member 21 and are not in contact with each other. This embodiment can provide the same effect as that described above. Furthermore, the radius of each of the substantially annular portions 25*a* and 25*b* is about 0.5 mm. In FIG. 14, the portion of each of the metallic pins 22*a*, 22*b* in the glass member 21 is indicated by broken lines.

Embodiment I-13

Figure 15:
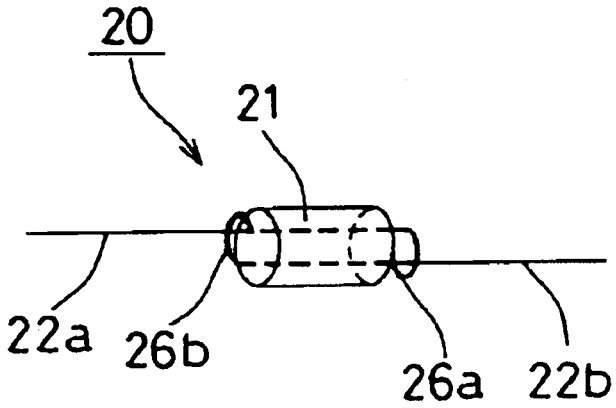
FIG. 15 is an enlarged perspective view showing a means for preventing overheating of a fluorescent lamp end according to Embodiment I-13 of the present invention.

In Embodiment I-13 of the present invention, a means for preventing overheating 20 of the fluorescent lamp of Embodiment I-1 has the following configuration, as shown in FIG. 15. The ring-shaped, substantially annular portions 25*a*, 25*b* of the metallic pins 22*a*, 22*b* of the fluorescent lamp of the above Embodiment I-12 are substituted by substantially annular portions 26*a*, 26*b* to be shaped into a circular arc (semicircle). This embodiment can provide the same effect as that described above. In FIG. 15, the portion of each of the metallic pins 22*a*, 22*b* in the glass member 21 is indicated by broken lines.

In Embodiment I-12 and I-13, the shape of the substantially annular portions 25*a*, 25*b*, 26*a*, and 26*b* is not limited to a ring or a circular arc. For example, they may be shaped into an ellipse or a part of it, a polygon or a part of it, an arch, or the like.

Embodiment II-1

Figure 16:
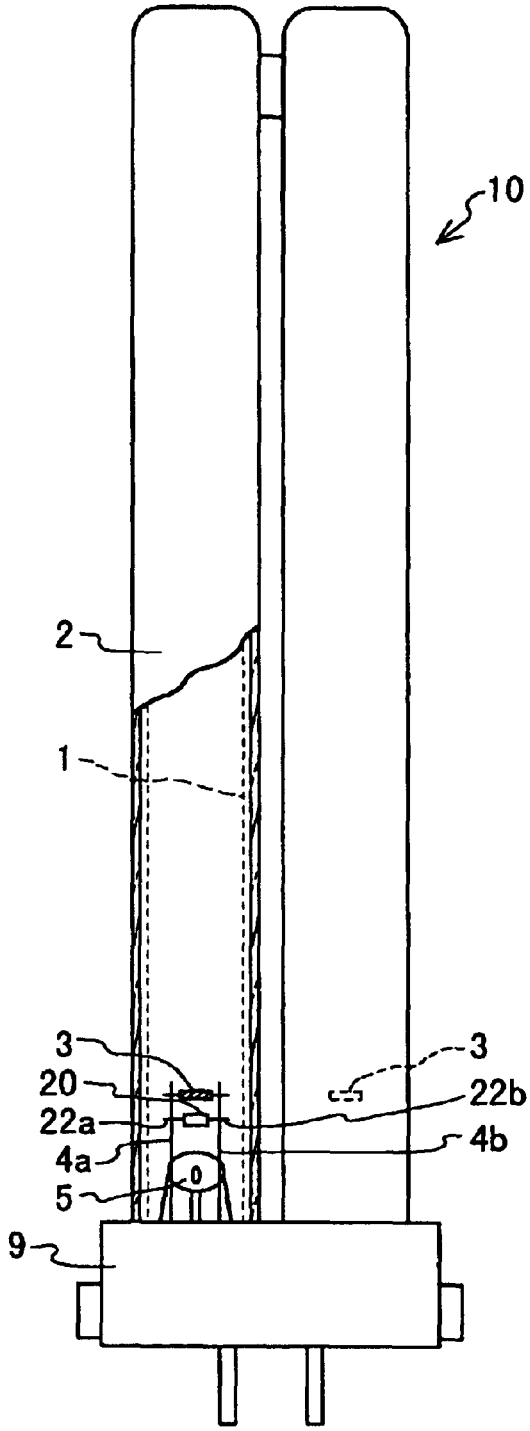
FIG. 16 is a partial cutaway front view showing a fluorescent lamp according to Embodiment II-1 of the present invention.

FIG. 16 shows a fluorescent lamp 10 of Embodiment II-1 of the present invention. The fluorescent lamp 10 is a 36-watt fluorescent lamp having a bridge junction, including a bulb 2 whose inner surface is coated with phosphors 1 and electrode coils 3 provided at both ends of the bulb 2. The electrode coils 3 have the same structure, so that the detailed description of the mounting portion of one electrode coil 3 is omitted. The bulb 2 is filled with argon gas at appropriate pressures (several 100 Pa) and mercury drops, and a resin base 9 that is made of polyethylene terephthalate and resists temperatures up to 155° C. is attached thereto in the final stage (of the fabrication).

Figure 17:
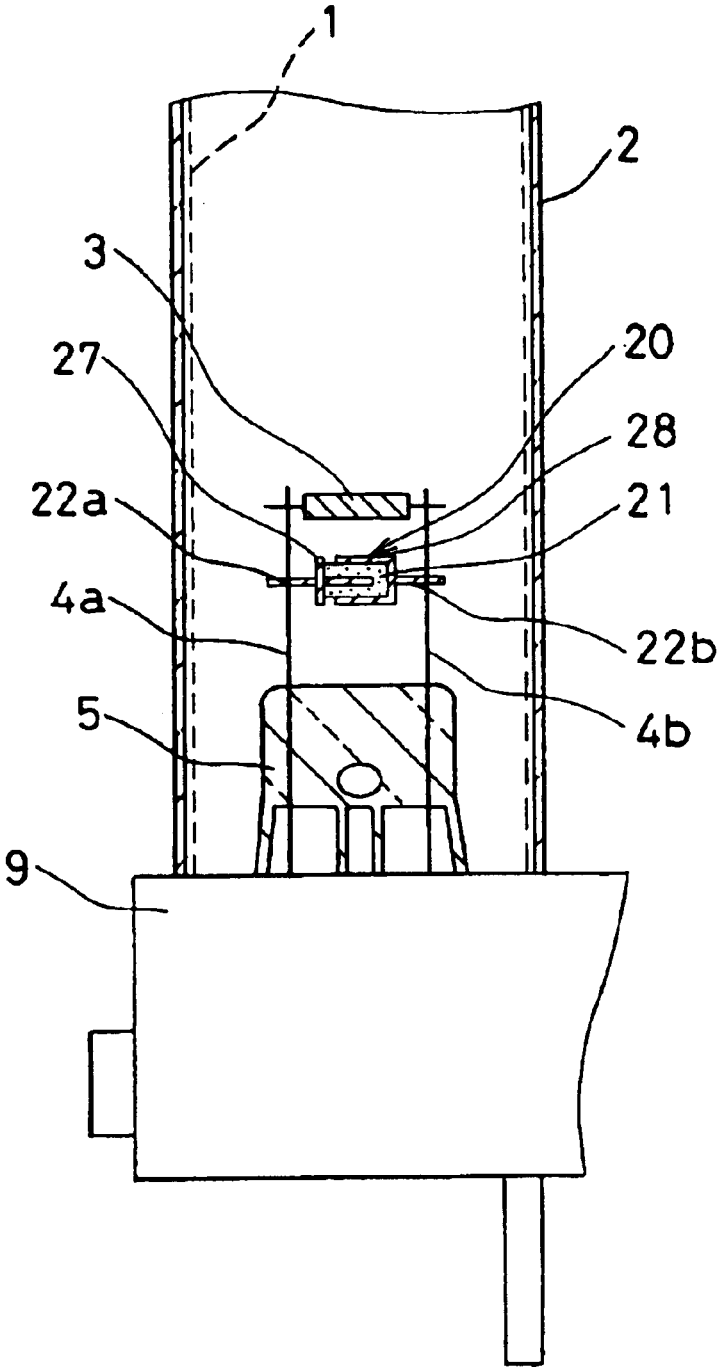
FIG. 17 is an enlarged cutaway front view showing a substantial part of the fluorescent lamp of FIG. 16.

As shown in FIG. 17, two lead wires 4*a*, 4*b* (made of nickel-plated iron wire) extend from a stem glass 5 attached to the end of the bulb 2 (made of soda-lime glass) to the inside of the lamp. The stem glass 5 is made of lead glass, and hereinafter referred to as "bulb-end glass 5". The electrode coil 3 is mounted between the lead wires 4*a* and 4*b*.

Furthermore, a means for preventing overheating 20 is mounted between the lead wires 4*a* and 4*b* so as to be placed between the bulb-end glass 5 and the electrode coil 3.

The means for preventing overheating 20 includes a glass member 21 and metallic pins 22*a*, 22*b* (made of nickel-plated iron wire).

The glass member 21 is substantially cylindrical, has an outer diameter of 2 mm and a length of 3 mm, and is made of soda-lime glass having a softening point of 695° C. The glass member 21 has a concavity formed at one end thereof. The concavity has a depth of 2 mm and an inner diameter of 0.7 mm that is a little larger than the wire diameter of the metallic pin 22*a*, which will be described later. The glass member 21 is housed in a metallic container 28 (made of nickel-plated iron wire) with a portion thereof projected from the container. The metallic container 28 is substantially cylindrical and has an inner diameter of about a little more than 2 mm. The distance from the inner bottom face of the container to the top (depth) is 2 mm. The metallic pin 22*b* is welded to the outer wall of the metallic container 28. The metallic pin 22*a* is inserted into the concavity of the glass member 21. The glass member 21 is placed between the metallic container 28 and a disk-shaped fastener 27. The fastener 27 has an outer diameter of 2 mm and is provided substantially in the mid-portion of the metallic pin 22*a* in the longitudinal direction. The means for preventing overheating 20 thus formed is mounted between the lead wires 4*a* and 4*b* in parallel with the electrode coil 3 by welding a pair of metallic pins 22*a*, 22*b* to the lead wires 4*a*, 4*b*. More specifically, the metallic pin 22*a* having the fastener 27 is inserted into the concavity at one end of the glass member 21, and the end surface of the glass member 21 comes into contact with the disk-shaped fastener 27. The circumferential surface of the glass member 21 between the fastener 27 of the metallic pin 22*a* and the end of the metallic container 28 on its opening side, i.e., the portion of the glass member 21 projected from the container (having a width of about 1 mm) is exposed directly to a discharge space. The glass member 21 exposed to the discharge space is located a minimum of 3 mm away from the electrode coil 3.

The disk-shaped fastener 27 with the metallic pin 22*a* is provided opposite to the opening of the metallic container 28. This makes it possible further to prevent the glass member 21 from falling off the metallic container 28 when it is melted. In the embodiment to be described later, e.g., the metallic pin 22*a* is not provided with the fastener 27 and the opening of the metallic container 28 faces to the electrode coil 3. In such a case, the end of the opening of the metallic container 28 is bent inward to prevent the glass member 21 from falling during melting.

For reference, a conventional fluorescent lamp without the glass member 21 housed in the metal container 28 (hereinafter, referred to as "comparative lamp") as shown in FIG. 28 is prepared.

The fluorescent lamp of this embodiment is combined with a C preheat type electronic ballast (double C type; a large resonant voltage is generated constantly across a fluorescent lamp, regardless of its condition) for lighting, as shown in FIG. 26. The electronic ballast, which does not have the function of detecting a rise in the voltage of a lamp, includes capacitors C1 and C2: The capacitor C1 is connected in series with the electrode coil 3 of the fluorescent lamp 10 and in parallel with the fluorescent lamp 10 on the side thereof opposed to the power source, and the capacitor C2 is connected in parallel with the fluorescent lamp 10 on the power source side thereof.

As a result, when an emissive coating is dissipated in the last period of electrode life, the electrode coil 3 generates heat extraordinarily because a cathode fall voltage rises to increase the current flowing into the electrode coil 3. The portion of the glass member 21 exposed to the discharge space is heated locally by the heat conducted from the electrode coil 3 through the lead wires 4*a*, 4*b* and the heat radiated directly from the electrode coil 3, and further by ion bombardment heating caused by intermittent pulse discharge from the electrode coil 3 of the opposite side, so that ion activation is caused in this portion, i.e., the ionic current can be prepared to flow locally into the glass.

When the electrode coil 3 is disconnected, a driving source for the current that has flowed into the electrode coil 3 via the capacitor C1 requires another closed circuit. As a result, a large amount of ionic current flows instantly into the portion of the glass member 21 exposed to the discharge space (a locally heated portion) between the fastener 27 of the metallic pin 22*a* and the end of the metallic container 28 on its opening side, and thus this portion is melted. At this time, the bulb-end glass 5 does not begin to melt faster than the glass member 21. Thereafter, the molten portion of the glass member 21 (the locally heated portion) increases gradually. However, since the glass member 21 is housed in the metallic container 28, the surface of the molten portion adheres to the metallic container 28. Thus, the molten piece does not fall off the metallic container 28, regardless of the orientation of the lamp during operation. Therefore, the glass member 21 is not cut off by melting, the closed circuit is not opened, and thus the molten state is maintained. When the glass member 21 is melted, the oscillation of the electronic ballast cannot be stopped. However, the resin base 9 can be kept at temperatures lower than the temperature it resists. Furthermore, the bulb-end glass 5 is not melted, and thus the fluorescent lamp of this embodiment can be maintained safely.

In the case where the electronic ballast is restarted after it is stopped for a while (when the double C type electronic ballast is used, a lamp starts even if the electrode coil 3 is disconnected), the glass member 21 is always melted first. The reason for this is as follows: The ion bombardment heating caused by intermittent pulse discharge tends to be more intensive at the end of the fastener 27 or the end of the metallic container 28 on its opening side, where a discharge distance becomes shorter, than at the base of the lead wires 4*a*, 4*b* in the vicinity of the bulb-end glass 5; in addition, the distance of the ionic conduction between the metallic pin 22*a* in the glass member 21 and the metallic container 28 is shorter than that between the lead wires 4*a* and 4*b* in the bulb-end glass 5. During the period of time when the glass member 21 is in the molten state and the electronic ballast is charged with electricity, the bulb-end glass 5 is not melted, and thus good results can be obtained.

Furthermore, when the fluorescent lamp is turned on normally before the emissive coating on the electrode coil 3 is dissipated, the impedance of the glass member 21 between the fastener 27 of the metallic pin 22*a* and the end of the metallic container 28 on its opening side is three or more orders of magnitude larger than the resistance of the electrode coil 3.

Thus, the current from the driving source that supplies current to the electrode coil 3 via the capacitor C1 flows substantially through the electrode coil 3 alone. When the lamp is turned on normally, the value of the current through the electrode coil 3 is about 250 mA, and that through the glass member 21 between the fastener 27 of the metallic pin 22*a* and the end of the metallic container 28 on its opening side is about 10$\mu$A.

On the other hand, in the case where the comparative lamp is combined with the above electronic ballast for lighting, after an emissive coating is dissipated and before the electrode coil 3 is disconnected, the bulb-end glass 5 is locally heated mainly by ion bombardment caused by the intermittent pulse discharge between the electrodes. Following the disconnection of the electrode coil 3, the bulb-end glass 5 is melted certainly, so that a lamp container (bulb 2) is broken. In addition, the temperature of the resin base 9 is raised to exceed the temperature at which the resin base 9 is deformed.

A lighting test is conducted in such a manner that the fluorescent lamp of this embodiment is combined with a C preheat type electronic ballast (see FIG. 27), which is not a double C type. In the test, the glass member 21 has been heated until the electrode coil 3 is disconnected after the emissive coating on the electrode coil 3 is dissipated, by the heat radiated from the red-hot electrode coil 3, the heat conducted through the lead wires 4*a*, 4*b*, and ion bombardment heating caused by the intermittent pulse discharge between the electrodes. As soon as the electrode coil 3 is disconnected, the glass member 21 is melted. In this case, since the glass member 21 is housed in the metallic container 28, the molten state can be maintained in the metallic container 28. Furthermore, when the electronic ballast is restarted after the fluorescent lamp is turned off, the present lamp does not start, and thus desired results can be obtained.

Embodiment II-2

Figure 18:
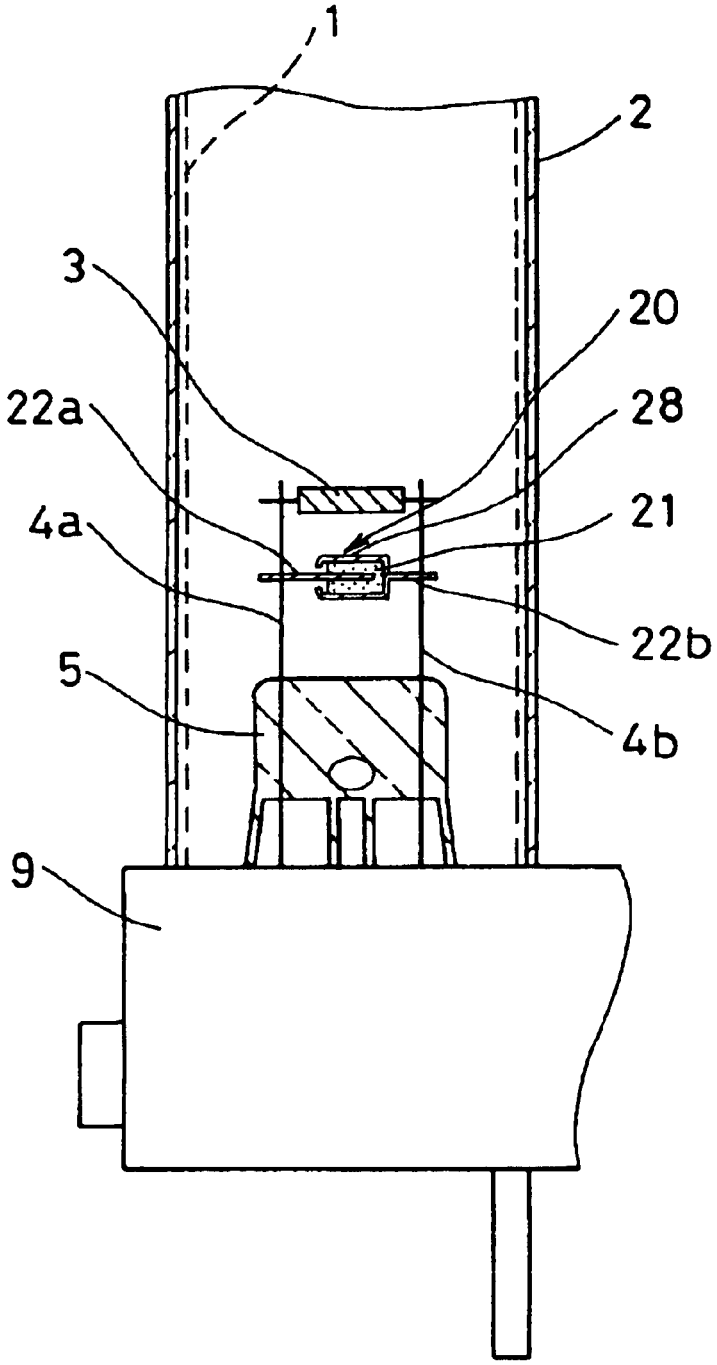
FIG. 18 is an enlarged cutaway front view showing a substantial part of a fluorescent lamp according to Embodiment II-2 of the present invention.

A means for preventing overheating 20 of the fluorescent lamp of Embodiment II-2 of the present invention has the following configuration, as shown in FIG. 18. The metallic pin 22*a* without the fastener 27 is used. The end of the metallic container 28 on its opening side is bent inward, and the bend at the end of the metallic container 28 cuts into the end surface of the glass member 21. This embodiment can prevent a lamp container (bulb 2) from being melted. In addition, the glass member 21 in the metallic container 28 does not flow out after melting. Furthermore, a depression may be formed on the circumferential surface of the glass member 21 midway along the drum portion thereof, and the bend at the end of the metallic container 28 may be cut into that depression (this configuration is not shown).

Embodiment II-3

Figure 19:
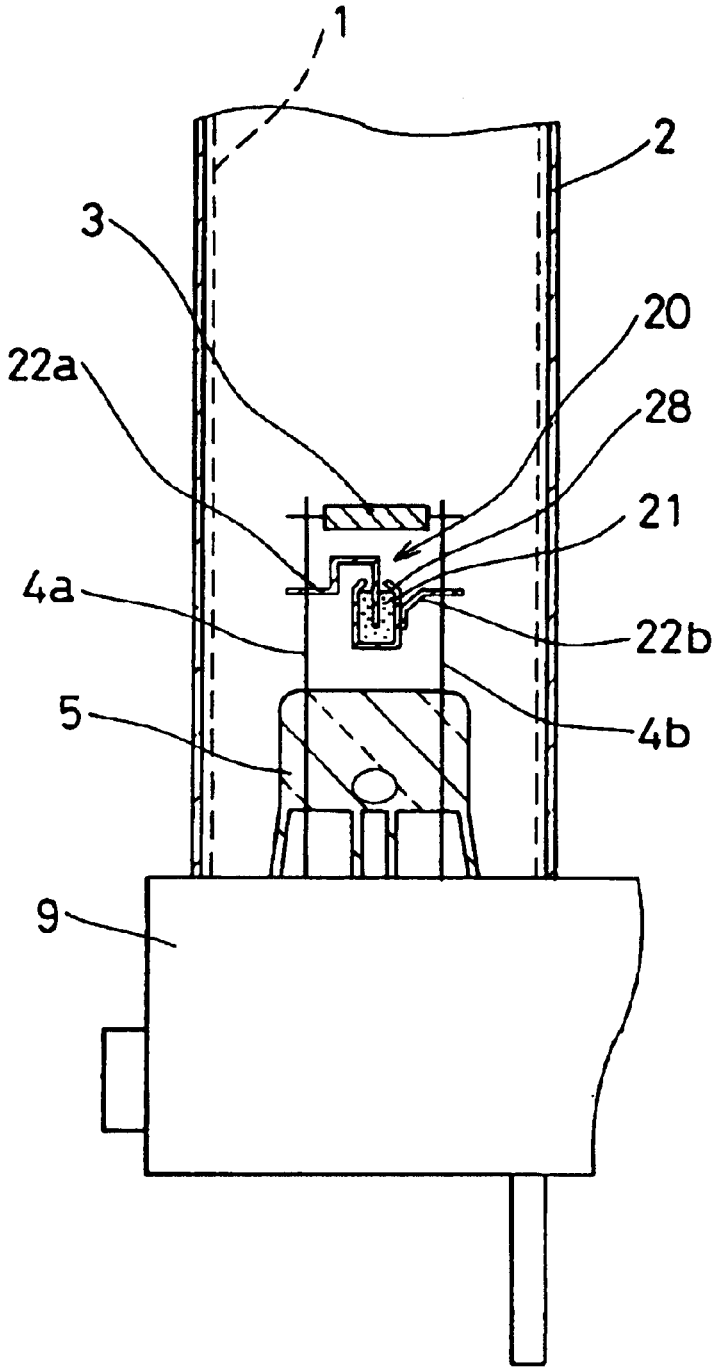
FIG. 19 is an enlarged cutaway front view showing a substantial part of a fluorescent lamp according to Embodiment II-3 of the present invention.

A means for preventing overheating 20 of the fluorescent lamp of Embodiment II-3 of the present invention has the following configuration, as shown in FIG. 19. A portion of the glass member 21, which is not covered with the metallic container 28 and is exposed to a discharge space, i.e., the opening of the metallic container 28, faces directly to the side of the electrode coil 3. This embodiment allows the glass member 21 to be locally heated efficiently by the heat radiated from the electrode coil 3 or intermittent pulse discharge, which ensures that the glass member 21 is melted faster than the bulb-end glass 5, and prevents a lamp container (bulb 2) from being melted.

Embodiment II-4

Figure 20:
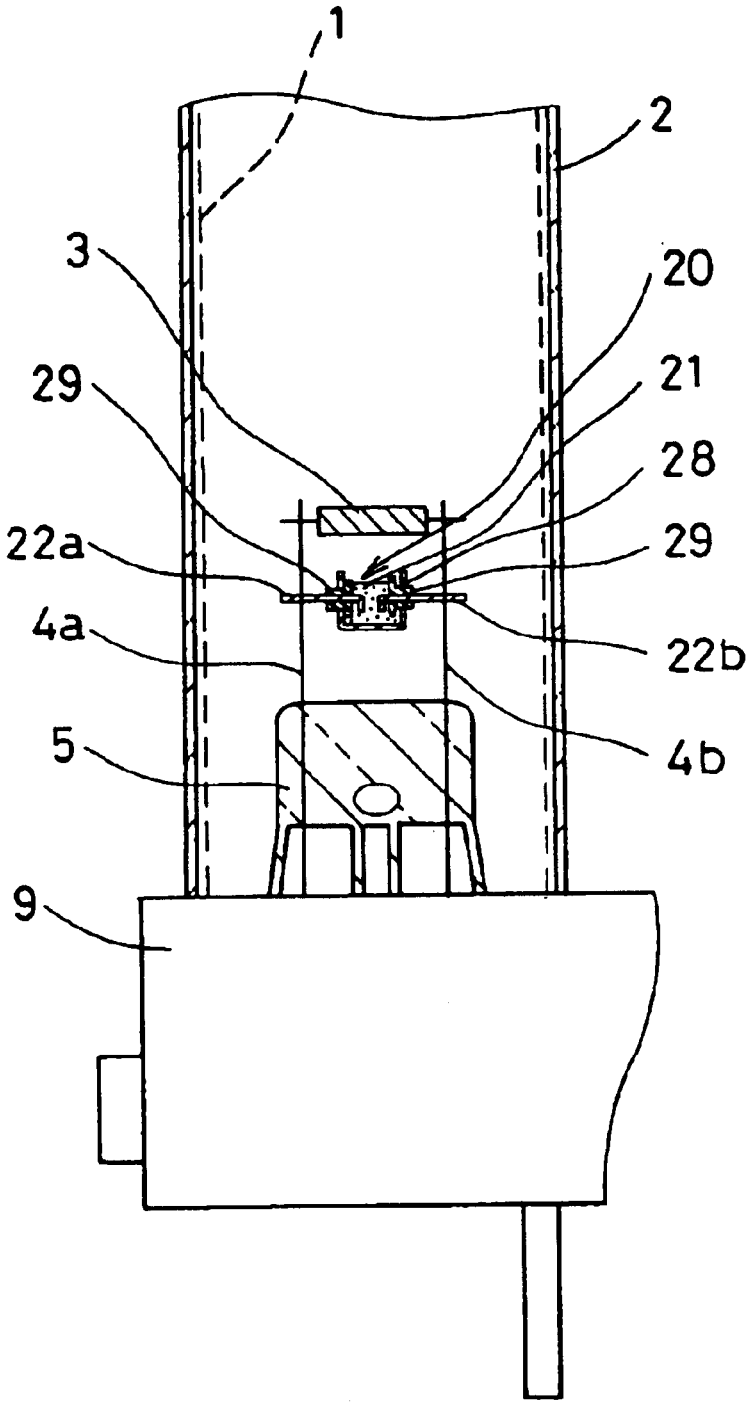
FIG. 20 is an enlarged cutaway front view showing a substantial part of a fluorescent lamp according to Embodiment II-4 of the present invention.

A means for preventing overheating 20 of the fluorescent lamp of Embodiment II-4 of the present invention has the following configuration, as shown in FIG. 20. A pair of metallic pins 22*a*, 22*b* and the metallic container 28 are insulated electrically with an electrical insulator 29 made of a ceramic material. The metallic pins 22*a*, 22*b* are inserted into the metallic container 28 to be placed in the glass member 21 in close proximity to each other. As with Embodiment II-3, the opening of the metallic container 28 faces to the side of the electrode coil 3. When the glass member 21 is melted, it is kept in the metallic container 28 that is supported by the metallic pins 22*a*, 22*b* via the electrical insulator 29. By varying the distance between the metallic pins 22*a* and 22*b*, the impedance of the glass member 21 between the metallic pins 22*a* and 22*b* before and after the electrode coil 3 is disconnected can be designed optimally. Furthermore, like each of the above embodiments, this embodiment can prevent a lamp container (bulb 2) from being melted so that the safety of the lamp can be maintained.

In this embodiment, the end of the metallic container 28 on its opening side may be bent inward, like Embodiment II-2.

Embodiment III

Figure 21:
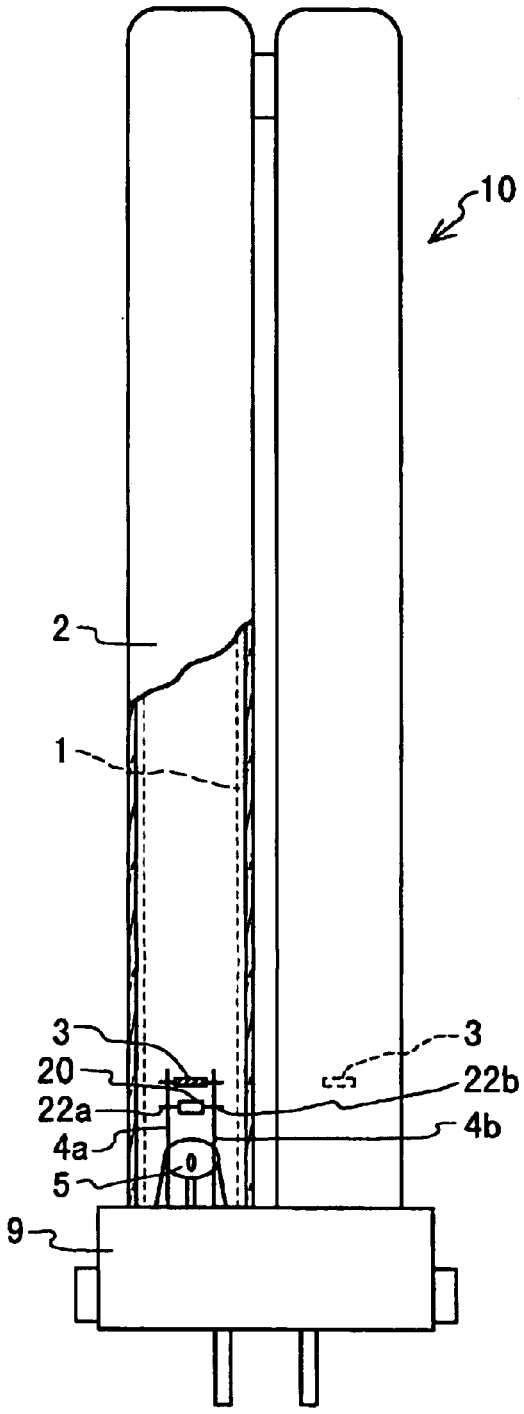
FIG. 21 is a partial cutaway front view showing a fluorescent lamp according to Embodiment III of the present invention.

FIG. 21 shows a fluorescent lamp 10 of Embodiment III of the present invention. The fluorescent lamp 10 is a 36-watt fluorescent lamp having a bridge junction, including a bulb 2 whose inner surface is coated with phosphors 1 and electrode coils 3 provided at both ends of the bulb 2. The electrode coils 3 have the same structure, so that the detailed description of the mounting portion of one electrode coil 3 is omitted. The bulb 2 is filled with argon gas at appropriate pressures (several 100 Pa) and mercury drops, and a resin base 9 that is made of polyethylene terephthalate and resists temperatures up to 155° C. is attached thereto in the final stage (of the fabrication).

Figure 22:
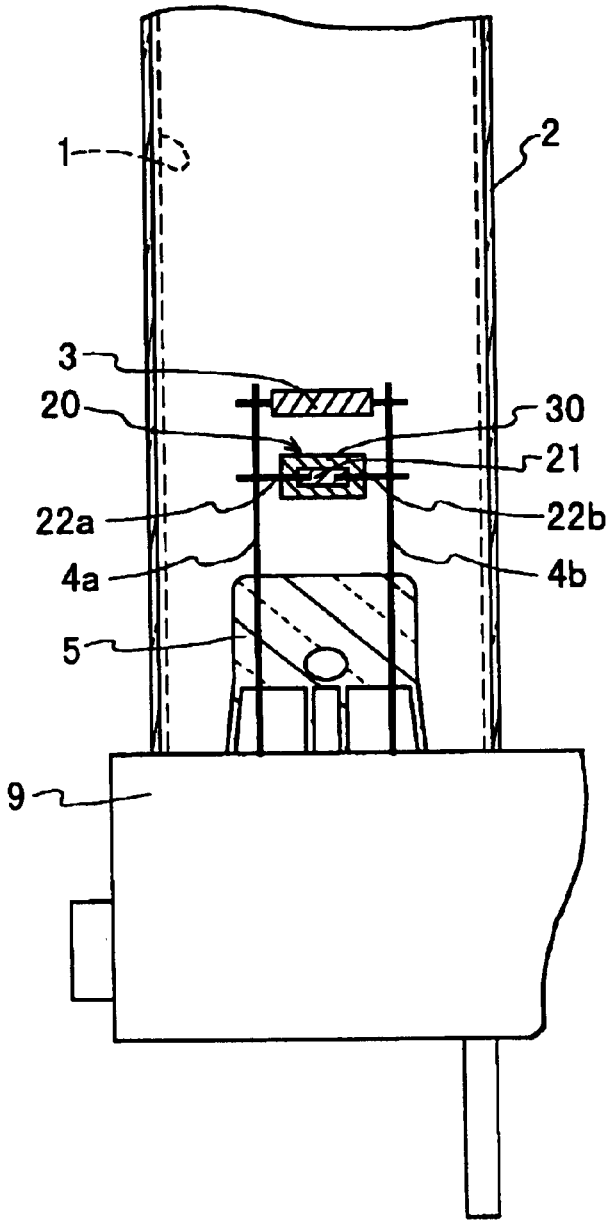
FIG. 22 is an enlarged cutaway front view showing a substantial part of the fluorescent lamp of FIG. 21.

As shown in FIG. 22, two lead wires 4*a*, 4*b* (made of nickel-plated iron wire) extend from a stem glass 5 attached to the end of the bulb 2 (made of soda-lime glass) to the inside of the lamp. The stem glass 5 is made of lead glass, and hereinafter referred to as "bulb-end glass 5". The electrode coil 3 is mounted between the lead wires 4*a* and 4*b*.

Furthermore, a means for preventing overheating 20 is mounted between the lead wires 4*a* and 4*b* so as to be placed between the bulb-end glass 5 and the electrode coil 3.

The means for preventing overheating 20 includes a glass member 21 and metallic pins 22*a*, 22*b*.

The glass member 21 is substantially cylindrical, has an outer diameter of a little less than 2 mm and a length of 6 mm, and is made of soda-lime glass having a softening point of 695° C. A pair of metallic pins 22*a*, 22*b* (made of nickel-plated iron wire) are inserted 2 mm into the glass member 21 through each of the end surfaces thereof by welding. The distance between the metallic pins 22*a* and 22*b* in the glass member 21 is about 2 mm. Furthermore, about 0.2 g inorganic heat-resisting material 30 (BX- 78A manufactured by Nissan Chemical Industries, Ltd., which resists temperatures of 1000° C. or more) is applied to the surface of the glass member 21 to be dried, degassed, calcined, and attached thereto. The glass member 21 is mounted between the lead wires 4*a* and 4*b* by welding the metallic pins 22*a*, 22*b* to the lead wires 4*a*, 4*b*. The glass member 21 is located closer to the electrode coil 3 than to the bulb-end glass 6.

For comparison, a fluorescent lamp without the glass member 21 coated with an inorganic heat-resisting material 30 that adheres to the glass member (hereinafter, referred to as "comparative lamp") as shown in FIG. 28 is prepared.

The fluorescent lamp of this embodiment is combined with a C preheat type electronic ballast (double C type; a large resonant voltage is generated constantly across a fluorescent lamp, regardless of its condition) for lighting, as shown in FIG. 26. The electronic ballast, which does not have the function of detecting a rise in the voltage of a lamp, includes capacitors C1 and C2: The capacitor C1 is connected in series with the electrode coil 3 of the fluorescent lamp 10 and in parallel with the fluorescent lamp 10 on the side thereof opposed to the power source, and the capacitor C2 is connected in parallel with the fluorescent lamp 10 on the power source side thereof.

As a result, in the fluorescent lamp of this embodiment, when an emissive coating is dissipated in the last period of electrode life, the electrode coil 3 generates heat extraordinarily. Thus, the glass member 21 is heated by the heat conducted from the electrode coil 3 through the lead wires 4*a*, 4*b*, the heat radiated directly from the electrode coil 3, and ion bombardment heating caused by the main discharge between the electrodes, so that the ionic current is prepared to flow through it.

When the electrode coil 3 is disconnected, a large amount of ionic current flows instantly into the glass member 21, and thus it is melted. However, since the glass member 21 is coated with the non-conductive inorganic heat-resisting material 30 that resists temperatures of 1000° C. or more, the molten state of the glass member can be maintained without the glass member being cut off by melting. When the glass member 21 is melted, the oscillation of the electronic ballast cannot be stopped. However, the resin base 9 can be kept at temperatures lower than the temperature it resists. Furthermore, the bulb-end glass 5 is not melted, and thus the fluorescent lamp of this embodiment can be maintained safely.

In the case where the electronic ballast is restarted after it is stopped for a while, the glass member 21 is always melted selectively. The reason for this is as follows: The ion bombardment heating caused by main discharge tends to be more intensive at the base of the metallic pins 22*a*, 22*b* in the vicinity of the glass member 21, where a discharge distance becomes shorter, than at the base of the lead wires 4*a*, 4*b* in the vicinity of the bulb-end glass 5; in addition, the distance of the ionic conduction between the metallic pins 22*a* and 22*b* in the glass member 21 is shorter than that between the lead wires 4*a* and 4*b* in the bulb-end glass 5. During the period of time when the glass member 21 is in the molten state, the bulb-end glass 5 is not melted.

Furthermore, when the fluorescent lamp is turned on normally before the emissive coating on the electrode coil 3 is dissipated, the impedance of the glass member 21 between the metallic pins 22*a* and 22*b* is three or more orders of magnitude larger than the resistance of the electrode coil 3. Thus, the current from the driving source that supplies current to the electrode coil 3 via the capacitor Cl flows substantially through the electrode coil 3 alone.

On the other hand, in the case where the comparative lamp is combined with the above electronic ballast for lighting, after an emissive coating is dissipated and before the electrode coil 3 is disconnected, the bulb-end glass 5 is locally heated mainly by ion bombardment caused by the main discharge. Following the disconnection of the electrode coil 3, the bulb-end glass 5 is melted certainly, so that a lamp container (bulb 2) is broken. In addition, the temperature of the resin base 9 is raised to exceed the temperature at which the resin base 9 is deformed.

A lighting test is conducted in such a manner that the fluorescent lamp of this embodiment is combined with a C preheat type electronic ballast (see FIG. 27), which is not a double C type. In the test, the glass member 21 has been heated until the electrode coil 3 is disconnected after the emissive coating on the electrode coil 3 is dissipated, by ion bombardment heating caused by the main discharge between the electrodes, the heat radiated from the red-hot electrode coil 3, and the heat conducted through the lead wires 4*a*, 4*b*. As soon as the electrode coil 3 is disconnected, the glass member 21 is melted. In this case, since the glass member 21 is coated with the non-conductive inorganic heat-resisting material 30, the molten state of the glass member can be maintained. Furthermore, when the electronic ballast is restarted after the fluorescent lamp is turned off, the present lamp does not start.

In the fluorescent lamp of the above embodiment, the distance between the metallic pins 22*a* and 22*b* is substantially equal to the insertion length of each of the metallic pins 22*a*, 22*b* into the glass member 21. However, the insertion length may be increased to shorten the distance between the metallic pins 22*a* and 22*b*, as long as the distance prevents contact between the metallic pins 22*a* and 22*b* when the glass member is melted. In that case, melting of a lamp container (bulb 2) can be prevented just as described above, and thus the safety of the lamp can be maintained. The insertion length of the metallic pins 22*a*, 22*b* into the glass member 21 by welding preferably is selected so that the glass member 21 does not slip off the metallic pins 22*a*, 22*b* when melted.

In the fluorescent lamp of the above embodiment, the cross section or the thickness of the point of each of the metallic pins 22*a*, 22*b* in the glass member 21 is the same as that of the portion of the metallic pin that continues on to the point. However, in the glass member 21, the cross section of the point of the metallic pin may be shaped to be different from that of the portion of the metallic pin that continues on to the point and/or the thickness of the point may be larger than that of the other portions. This makes it difficult for the glass member 21 to slip off the metallic pins 22*a*, 22*b* when melted, thereby increasing the reliability of the function that prevents the lamp container (bulb 2) from being melted.

Furthermore, as with the fluorescent lamp of the above embodiment, using an inorganic heat-resisting material having a melting point in excess of at least 200° C. above the softening point of the glass member 21 to be used with the material as the inorganic heat-resisting material 30 can prevent the molten glass member 21 from being cut off by melting.

When the metallic pins to which a substance having a lower work function, such as cesium oxide or the like is attached are used in place of the metallic pins 22*a*, 22*b* of the fluorescent lamp of Embodiments I–III, ion bombardment heating caused by the main discharge between the electrodes after emissive coating dissipation can be concentrated on the metallic pins 22*a*, 22*b*, and thereby increasing the reliability of the function that prevents the lamp container (bulb 2) from being melted.

Embodiment IV

In the above Embodiments I–III, the glass member 21 that constitutes a means for preventing overheating is mounted between the lead wires 4*a* and 4*b* via the metallic pins 22*a*, 22*b*. However, the present invention is not limited to such a configuration. For example, the glass member may be mounted directly between the lead wires 4*a* and 4*b* without using the metallic pins 22*a*, 22*b*.

Furthermore, in the above Embodiments I–III, a bulb-end glass is the stem glass 5. However, the present invention is not limited to such a configuration. For example, the present invention can be applied to the case where the bulb-end glass is an end glass formed by a pinch-seal method.

In Embodiment IV, a pinch-seal-type fluorescent lamp is provided so that a mounted bead is used as the means for preventing overheating 20 of the present invention.

Figure 23:
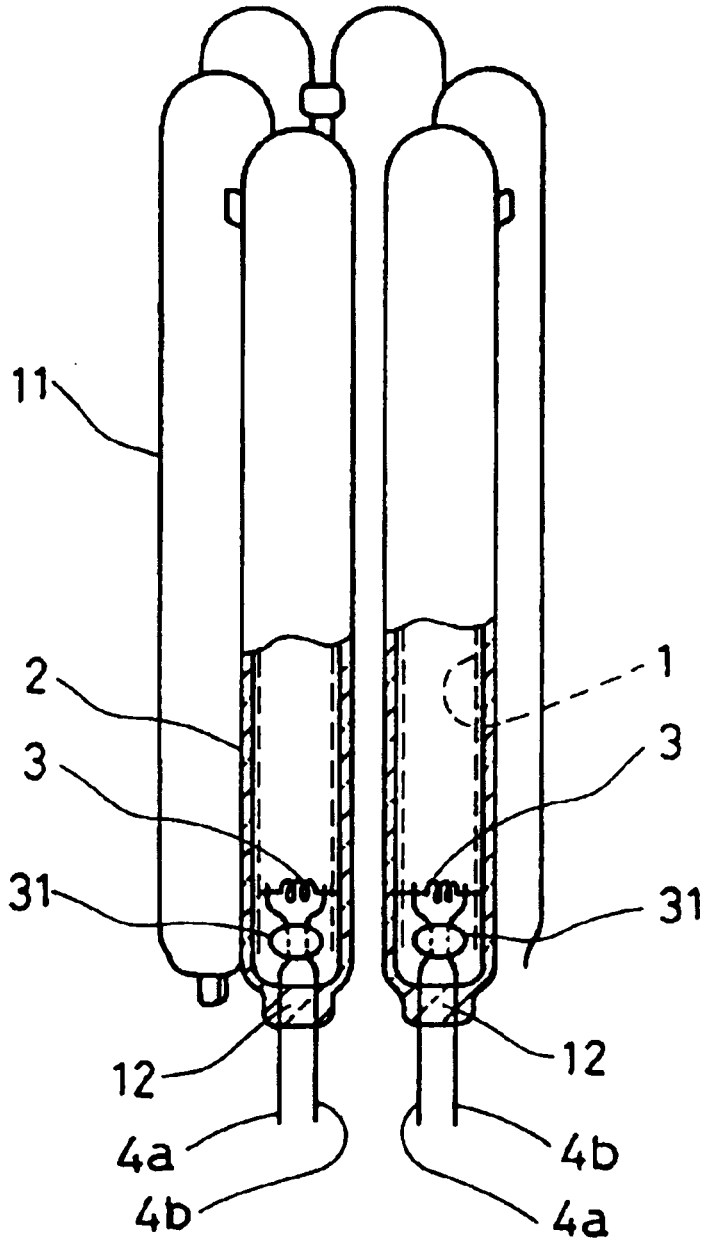
FIG. 23 is a partial cutaway perspective view showing a light-emitting tube of a fluorescent lamp according to Embodiment IV of the present invention.
Figure 24:
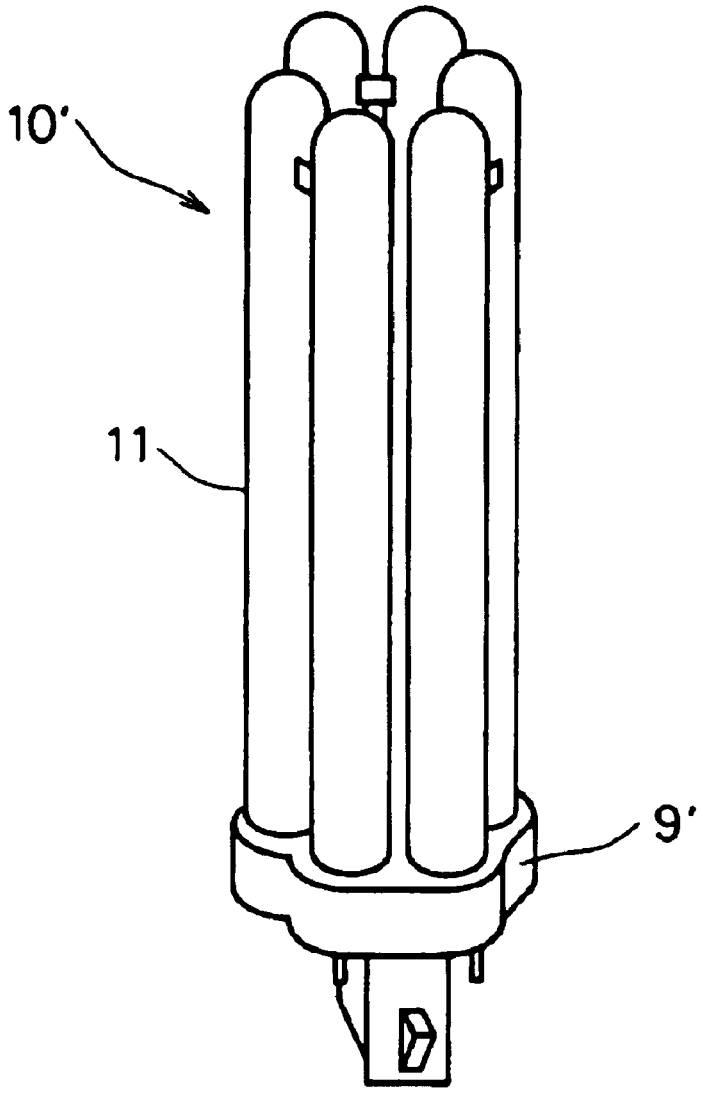
FIG. 24 is a perspective view of a fluorescent lamp according to Embodiment IV of the present invention.

FIG. 23 shows a configuration of a light-emitting tube 11 of a compact fluorescent lamp of Embodiment IV of the present invention. The light-emitting tube 11 includes six bulbs 2 (straight glass tube, made of soda-lime glass) that are joined with bridge junctions so as to form a series of discharge paths. A pair of electrode coils 3, 3 made of tungsten are provided on both tube's ends of the light-emitting tube 11. Each electrode coil 3 is mounted between a pair of lead wires 4*a* and 4*b* (made of nickel-plated iron wire). A pair of lead wires 4*a*, 4*b* are held by a bulb-end glass 12 of the bulb 2, with which the light-emitting tube 11 is sealed hermetically. A part of each of the lead wires 4*a*, 4*b* between the electrode coil 3 and the bulb-end glass 12 is bent so that the space between the lead wires is narrowed. A bead glass 31 is mounted on the bend. The bead glass 31 controls the space between a pair of lead wires 4*a* and 4*b*, and thus the electrode coil 3 is held stably (i.e., so-called a bead mounting method). The inner surface of the main part of the light-emitting tube 11 is coated with phosphors 1, and the tube is filled with mercury and argon gas at a pressure of 400 Pa. As shown in FIG. 24, a resin base 9' that is made of polyethylene terephthalate and resists temperatures up to 155° C. is attached to the light-emitting tube 11 so as to complete the fluorescent lamp In the 32-watt compact fluorescent lamp 10' thus formed, soda-lime glass having a softening point of 695° C. and a lower volume resistance is employed as the bead glass 31 as a means for preventing overheating. According to this configuration, at the end of the life of a lamp, the temperature of the bead glass 31, which is close to the electrode coil 3, is higher than that of the bulb-end glass 12. Thus, the value of the volume resistance of the bead glass 31 is lower. Furthermore, the distance between the lead wires 4*a* and 4*b* is narrower at the portion where the lead wires are held by the bead glass 31 than that where they are held by the bulb-end glass 12. Thus, the electrical insulation provided by the bead glass 31 is lower than that by the bulb-end glass 12. Although the bead glass 31 and the bulb-end glass 12 are made of the same soda-lime glass, only the portion of the bead glass 31 is melted selectively to cause a breakdown. Because of this lower electrical insulating property of the bead glass 31, it can act as a means for preventing overheating at the end of lamp life. This can prevent reliably the bulb-end glass 12 from being melted and causing a breakdown.

When the bead glass 31 is melted, to prevent it from falling because of, e.g., the vibration of a lamp, the above embodiment can have the following configuration.

Figure 25:
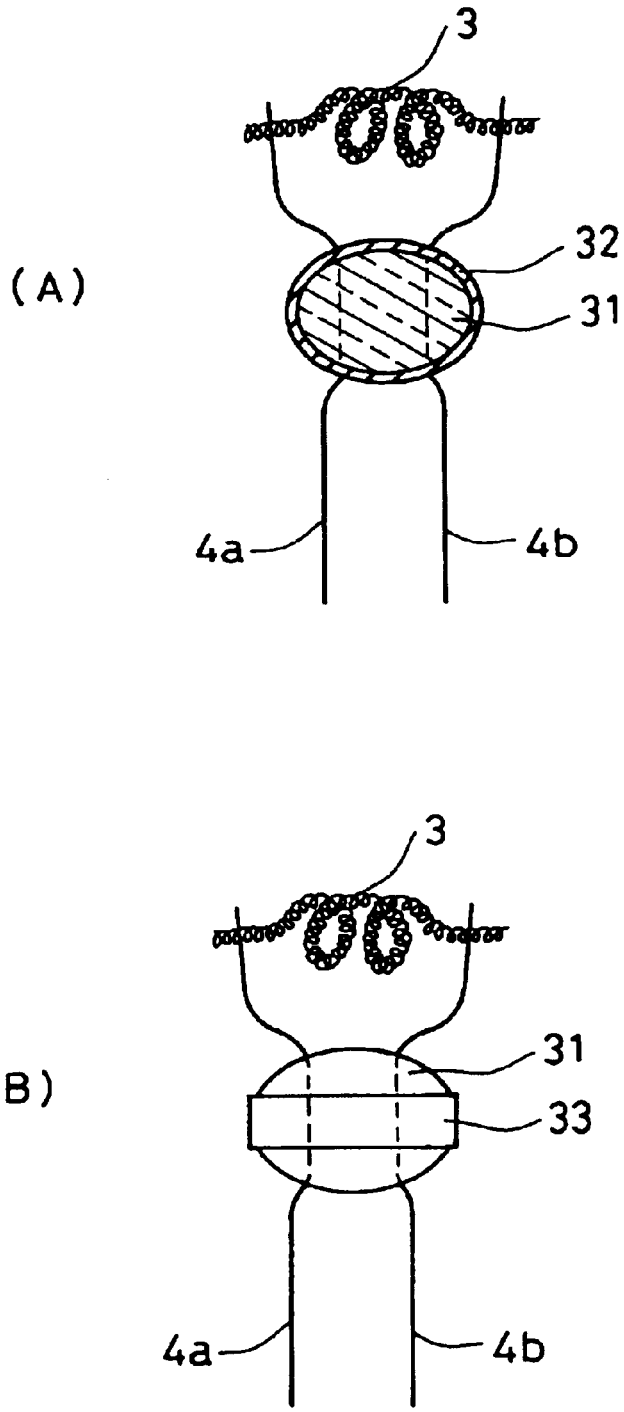
FIG. 25(A) is a cross-sectional view showing a means for preventing overheating of a fluorescent lamp end according to Embodiment IV of the present invention.
FIG. 25(B) is a front view showing a means for preventing overheating of a fluorescent lamp end according to Embodiment IV of the present invention.

For example, as shown in FIG. 25(A), an inorganic material, such as a ceramic coating 32 of $Al_2O_3$—$SiO_2$ whose melting point is higher than that of the bead glass 31 is provided on the outer surface of the bead glass 31. This configuration can prevent the bead glass 31 from falling because the ceramic coating 32 is not melted, even if the bead glass 31 is melted. The ceramic coating 32 is formed by a relatively simple manufacturing process, in which the bead glass 31 is coated by spraying suspension solutions of $Al_2O_3$—$SiO_2$ to be dried, and burned.

Alternatively, as shown in FIG. 25(B), a metallic band 33 of stainless steel is provided on the circumference of the bead glass 31 so as not to form a short circuit between the lead wires 4*a* and 4*b*. This configuration also reliably can prevent the bead glass 31 from falling. Furthermore, a metallic band in the form of a wire net may be used as the metallic band 33.

The mechanism that prevents the bead glass 31 from falling is not limited to those shown in FIGS. 25(A) and 25(B). For example, it is possible to wind the bead glass 31 with a wire of metal or the like or to insert a metal plate, a metal wire net, a metal rod, or the like into the glass member 31.

In the fluorescent lamp of Embodiments I–IV, a non-conductive inorganic heat-resisting material may be applied in the same manner as in Embodiment III to the surface of the bulb-end glass 5, 12 on the side of the electrode coil 3 including the area between the lead wires 4*a* and 4*b*. This configuration can prevent the bulb-end glass 5, 12 from being heated by ion bombardment caused by the main discharge between the electrodes, which ensures that the means for preventing overheating can be melted faster than the bulb-end glass 5, 12.

Furthermore, the means for preventing overheating (glass member 21, 31) may be located closer to the electrode coil 3 than to the bulb-end glass 5, 12 so as to be subjected readily to the heat radiated from the electrode coil 3 that glows red-hot after emissive coating dissipation and the heat conducted through the lead wires 4*a*, 4*b*, and thereby increasing the reliability of the function that prevents a lamp container (bulb 2) from being melted.

Furthermore, a fluorescent lamp having a bridge junction has been described in the above Embodiments I–IV. However, the fluorescent lamp of the present invention is not limited thereto. The present invention can be widely applied to the well-known fluorescent lamps, such as a a straight-tube fluorescent lamp, a circular-shaped fluorescent lamp, or the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A fluorescent lamp comprising:

a bulb provided with a pair of electrode coils at both ends thereof, each of the electrode coils mounted between two lead wires held by a bulb-end glass, a means for preventing overheating provided with a glass member and a first and a second metallic pin for supporting the glass member, the first and the second metallic pin being provided not in contact with each other, wherein the means for preventing overheating of the bulb-end glass is mounted between the lead wires located between the electrode coil and the bulb-end glass with one end of each of the first and the second metallic pin connected to the lead wires, respectively, the other end of one of the first and the second metallic pin is projected from the glass member or positioned therein, and the other metallic pin is wound around the glass member with the other end positioned in the glass member so as to be spaced apart from the other metallic pin via the glass member, the other metallic pin extending through a substantially annular portion of the wound metallic pin, the means for preventing overheating melting and retaining its molten state to connect the lead wires electrically just before or after the electrode coil is disconnected.

2. The fluorescent lamp according to claim 1, wherein the glass member has a depression formed on a circumferential surface thereof, and the metallic pin is wound around the depression.

3. The fluorescent lamp according to claim 1, wherein a metallic band is wound around the glass member.

4. The fluorescent lamp according to claim 3, wherein the other end of the metallic pin is connected to the metallic band.

5. The fluorescent lamp according to claim 3, wherein the metallic band is in the form of a net.

6. The fluorescent lamp according to claim 1, wherein a metallic band is wound around at least both ends of the glass member, and the other end of each of the first and the second metallic pin is connected to the metallic band, respectively.

7. The fluorescent lamp according to claim 1, wherein a surface of the glass member is coated with a non-conductive inorganic heat-resisting material.

8. The fluorescent lamp according to claim 1, wherein a substance having a lower work function is attached to a surface of the metallic pin.

9. The fluorescent lamp according to claim 1, wherein the means for preventing overheating includes a glass member mounted between the lead wires and a means for preventing falling of the glass member from the lead wires during melting.

10. The fluorescent lamp according to claim 9, wherein the means for preventing falling is provided on a circumference of the glass member.

11. The fluorescent lamp according to claim 9, wherein the means for preventing falling is formed of a non-conductive inorganic heat-resisting material or a metallic band.

12. The fluorescent lamp according to claim 1, wherein the means for preventing overheating includes a glass member, and an electrical volume resistance of the glass member is lower than that of the bulb-end glass.

13. The fluorescent lamp according to claim 1, wherein the means for preventing overheating includes a glass member, and an electrical conduction between the lead wires through the glass member is continued just before or after the electrode coil is disconnected.

14. The fluorescent lamp according to claim 1, wherein at least a portion of a surface of the bulb-end glass in the lamp is coated with a non-conductive inorganic heat-resisting material.

15. The fluorescent lamp according to claim 1, wherein the means for preventing overheating is located closer to the electrode coil than to the bulb-end glass.

16. A fluorescent lamp comprising:

a bulb provided with a pair of electrode coils at both ends thereof, each of the electrode coils mounted between two lead wires held by a bulb-end glass, a means for preventing overheating, provided with a glass member, a first and a second metallic pin for supporting the glass member, and a container configured to house the glass member.

wherein one end of each of the first and the second metallic pin is connected to the lead wires, respectively, and the first and the second metallic pin are provided not in contact with each other, the means for preventing overheating of the bulb-end glass is mounted between the lead wires located between the electrode coil and the bulb-end glass;

at least one of the first and the second metallic pin supports the glass member indirectly by supporting the container, the glass member is housed in the container so that a portion of the glass member is exposed to a discharge space, and the means for preventing overheating melting and retaining its molten state to connect the lead wires electrically just before or after the electrode coil is disconnected.

17. The fluorescent lamp according to claim 16, wherein the portion of the glass member exposed to the discharge space faces to the electrode coil.

18. The fluorescent lamp according to claim 16, wherein one of the metallic pins is inserted into the glass member, and the other is connected to the metallic container.

19. The fluorescent lamp according to claim 18, wherein one of the metallic pins, which has been inserted into the glass member, has a fastener, the fastener comes into contact with an end surface of the glass member, and a length of the glass member is longer than a depth of the container in an insertion direction of the metallic pin.

20. The fluorescent lamp according to claim 16, wherein an end of an opening of the container is bent inward.

21. The fluorescent lamp according to claim 16, wherein the container is held by the first and the second metallic pin via an electrical insulator, and both metallic pins are provided in close proximity in the glass member.

22. The fluorescent lamp according to claim 16, wherein a surface of the glass member is coated with a non-conductive inorganic heat-resisting material.

23. The fluorescent lamp according to claim 16, wherein a substance having a lower work function is attached to a surface of the metallic pin.

24. The fluorescent lamp according to claim 16, wherein the means for preventing overheating includes a glass member mounted between the lead wires and a means for preventing falling of the glass member from the lead wires during melting.

25. A fluorescent lamp comprising:

a bulb provided with a pair of electrode coils at both ends thereof, each of the electrode coils mounted between two lead wires held by a bulb-end glass, a means for preventing overheating provided with a glass member, and a first and a second metallic pin for supporting the glass member, wherein one end of each of the first and the second metallic pin is connected to the lead wires, respectively, and the first and the second metallic pin are provided not in contact with each other, the means for preventing overheating of the bulb-end glass is mounted between the lead wires located between the electrode coil and the bulb-end glass;

the first and the second metallic-pin are inserted into the glass member, and a distance between the metallic pins is substantially equal to or shorter than an insertion length of the metallic pin into the glass member, a surface of the glass member is coated with a non-conductive inorganic heat-resisting material, and the means for preventing overheating melting and retaining its molten state to connect the lead wires electrically just before or after the electrode coil is disconnected.

26. The fluorescent lamp according to claim 25, wherein the first and the second metallic pin are inserted into the glass member, and a point of the metallic pin in the glass member differs from a portion that continues on to the point in cross section, or has a thickness larger than that of the portion that continues on to the point.

27. The fluorescent lamp according to claim 25, wherein the inorganic heat-resisting material has a melting point in excess of 200° C. or more above a softening point of the glass member.

28. The fluorescent lamp according to claim 25, wherein a substance having a lower work function is attached to a surface of the metallic pin.

29. The fluorescent lamp according to claim 25, wherein the means for preventing overheating includes a glass member mounted between the lead wires and a means for preventing falling of the glass member from the lead wires during melting.

30. The fluorescent lamp according to claim 29, wherein the means for preventing falling is provided on a circumference of the glass member.

31. The fluorescent lamp according to claim 29, wherein the means for preventing falling is formed of a non-conductive inorganic heat-resisting material or a metallic band.

32. The fluorescent lamp according to claim 25, wherein the means for preventing overheating includes a glass member, and an electrical volume resistance of the glass member is lower than that of the bulb-end glass.

33. The fluorescent lamp according to claim 25, wherein the means for preventing overheating includes a glass member, and an electrical conduction between the lead wires through the glass member is continued just before or after the electrode coil is disconnected.

34. The fluorescent lamp according to claim 25, wherein at least a portion of a surface of the bulb-end glass in the lamp is coated with a non-conductive inorganic heat-resisting material.

35. The fluorescent lamp according to claim 25, wherein the means for preventing overheating is located closer to the electrode coil than to the bulb-end glass.

* * * * *